United States Patent [19]

Ayler et al.

[11] Patent Number: 4,458,945

[45] Date of Patent: Jul. 10, 1984

[54] OIL RECOVERY MINING METHOD AND APPARATUS

[76] Inventors: Maynard F. Ayler, 1315 Normandy Rd., Golden, Colo. 80401; George Vranesh, P.O. Box 871, Boulder, Colo. 80306

[21] Appl. No.: 307,650

[22] Filed: Oct. 1, 1981

[51] Int. Cl.[3] ..... E21C 41/10

[52] U.S. Cl. ..... 299/2; 166/50; 166/77; 299/19; 299/12

[58] Field of Search ..... 299/2, 19; 166/50, 77; 405/130, 268

[56] References Cited

U.S. PATENT DOCUMENTS

| | | | |
|---|---|---|---|
| 1,722,679 | 7/1929 | Ranney | 299/2 |
| 1,884,859 | 10/1932 | Ranney | 166/50 X |
| 2,193,219 | 3/1940 | Bowie et al. | 405/130 X |
| 2,989,294 | 6/1961 | Coker | 299/2 |
| 4,165,903 | 8/1979 | Cobbs | 299/2 |

*Primary Examiner*—Ernest R. Purser
*Attorney, Agent, or Firm*—Charles W. Helzer

[57] ABSTRACT

New and improved techniques, systems and equipment for the practical underground mining of petroleum from both virgin and depleted oil fields under certain geological conditions, are described. A method of drilling relatively small diameter, drainage-type oil wells using a fluid and cutting control assembly from within an access underground drilled tunnel, is provided. The fluid and cutting control assembly facilitates the safe underground drilling and installation of the small diameter, drainage-type oil wells which can be operated either under the natural pressures occurring in the geological strata, as gravity drain wells or by suitable secondary treatment measures artificially pressurized to facilitate drainage of oil from oil bearing strata into which such wells are drilled. Techniques and equipment to facilitate the safe drilling of such wells, placing them into production and thereafter controlling operation of the mine workings in a safe and reliable manner, is described, together with the control system, sensors and other equipment required for safe installation and operation of an underground petroleum mine.

63 Claims, 18 Drawing Figures

Fig. 3
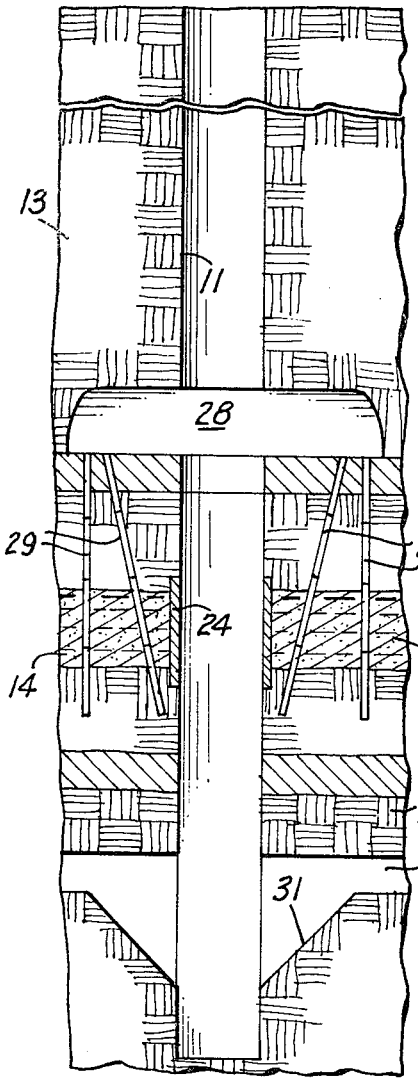
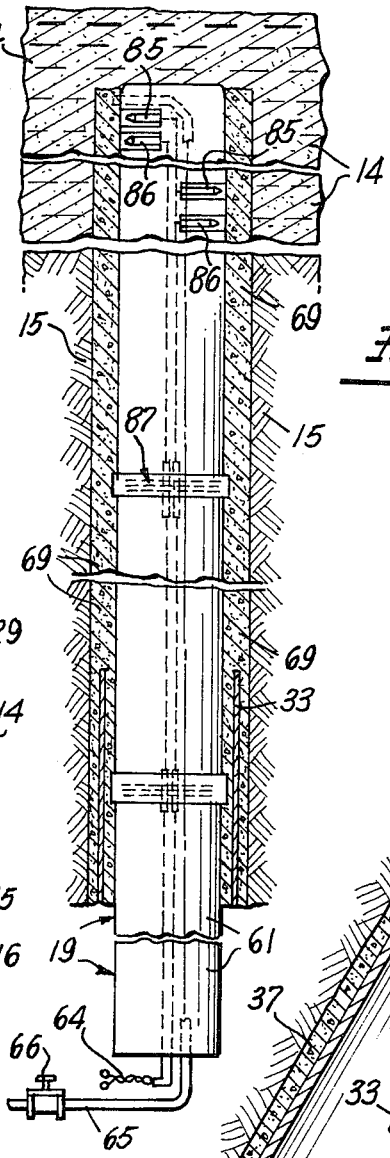
Fig. 9
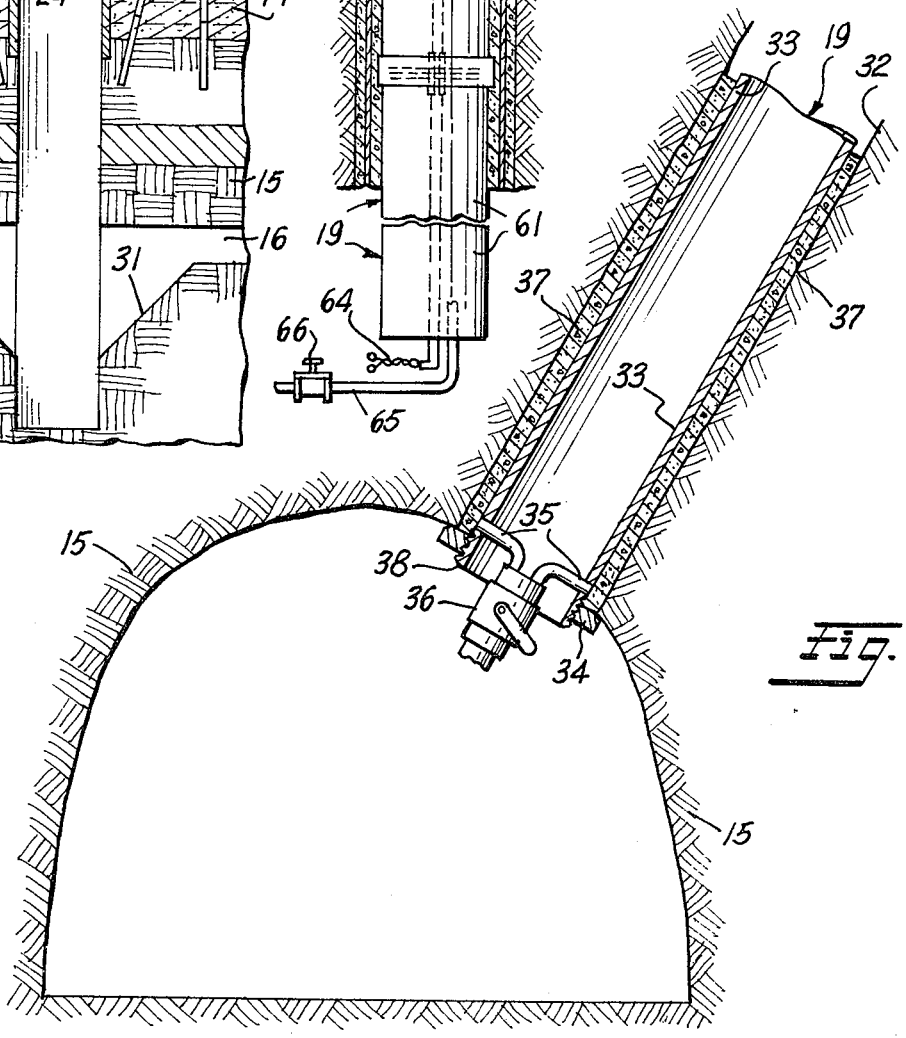
Fig. 4

51
53
54
52
33
37
37
15
15
38
39
16
41
42
19
45
43
49
40
41
46
47
48
44
52

14
65
62
63
61
69
64
33
15
61
33
15
38
39
16
42
19
45
43
40
46
49
41
47
44
64
48
41
50
66
65
67
68

OIL RECOVERY MINING METHOD AND APPARATUS

TECHNICAL FIELD

This invention relates to the recovery of oil using mining techniques.

More specifically, the invention relates to a novel method and apparatus for the recovery of oil contained in oil bearing fields which are either virgin (untapped previously by known oil well drilling and pumping techniques), currently producing fields, or are classified as depleted and incapable of further oil production using existing surface oil well drilling, pumping and secondary treatment techniques. The recovery of oil from such fields is achieved by the application of novel underground mining methods and apparatus used in combination with oil well technology.

BACKGROUND PROBLEM AND PRIOR ART

The petroleum industry began in 1859 in Pennsylvania when the Drake well was drilled purposely to find liquid petroleum. The petroleum industry grew very slowly. It was not until 1901, with the discovery of the Spindletop field in Texas, that the world was convinced there was more petroleum than could ever be consumed. The birth of the automobile industry created a growing demand for petroleum products and an accelerated growth in the petroleum industry.

As the world had more petroleum than it could consume, the oil reservoirs found prior to 1940 were produced utilizing only the natural energies of the petroleum accumulation. In the late 30's waterflooding and gas injection were initiated in some petroleum reservoirs that had been depleted of their natural energies. These reservoirs were usually at pressures of less than 100 psi and were waterflooded at pressures of 400 to 800 psi.

After World War II the petroleum industry began utilizing more engineering in the development of petroleum reservoirs. This resulted in initiation of pressure maintenance by water injection and gas injection much earlier in the productive life of the reservoir. These injection projects were carried out at pressures usually in excess of 500 psi and often at pressures as high as 4000 psi. Oil remaining in these reservoirs contains considerable gas in solution.

In the late '50's it was already evident that finding new petroleum was becoming more difficult and more expensive. The world demand for petroleum had grown at an unpredicted rate. It became evident that the world would soon be short of petroleum. As a result, new processes were initiated in an attempt to recover more of the petroleum that had already been found. These new processes, fire-flooding, steam stimulation, steam flooding and misciable flooding, were initiated in an effort to increase the recovery from existing reservoirs. Most of these techniques were very expensive and in most cases did not achieve the desired degree of success. At present, the only process still being utilized is steam stimulation and steam flooding, in reservoirs with low gravity and viscosity oil.

In the mid '60's the industry began to investigate possibilities of tertiary recovery in reservoirs that had been water flooded in the mid '40's. Tertiary projects utilizing caustics, surfactants, special emulsions and polymers were initiated on an experimental basis. At the present time the Federal government, through ERDA, and the petroleum industry are continuing to investigate the tertiary recovery processes. None of these techniques have been classified an economic success with a great future potential of recovering large quantities of additional petroleum.

In the late 1960's the first large scale commercial mining of an oil sand was initiated in Alberta, Canada. This project is strip mining a "tar" sand and processing the sand to recover the hydrocarbon. The project was uneconomic at world oil prices prior to 1973. The project became economical after petroleum prices were increased. As of this writing other projects scheduled in the area have still not been placed on a production status because of economics.

Oil reservoirs which may be candidates for a mining recovery process can be classified into two general categories, depleted or virgin. The depleted reservoirs were estimated to contain some 300 billion barrels of unrecovered oil in a 1976 study by the National Petroleum Council and are estimated to comprise between 60 and 80 percent of the oil originally present in these fields. The depleted reservoirs can be classified into two general categories; those which have undergone some type of secondary recovery process and those which have only been primarily depleted. The former category would probably be classified as containing the greatest amount of remaining petroleum because they represent the greatest number of petroleum reservoirs. A considerable number of primary depleted reservoirs exist in the viscous crude oil category. Some of these reservoirs have undergone steam stimulation but not a secondary recovery process. The volume of oil in this category is probably in excess of 150 billion barrels.

The depleted systems which have undergone secondary recovery processes are the ones flooded in the late '30's and early '40's. These were at relatively shallow depths and which were at very low pressures. Some of these reservoirs were placed on a vacuum during World War II and hence would contain very small amounts of gas in solution in the oil. The low gas in solution results in very small amounts of any gas in the reservoir to be utilized as a displacing fluid.

The other type of reservoirs which have undergone secondary recovery will have been flooded at pressures in excess of 500 psi and will have considerable gas in solution and possibly free gas to assist in the removal of fluids from the formation.

These depleted reservoirs will probably contain oil having the following properties.

Viscosity—1 to 10 centiposes
Gravity—greater than 25° API
Gas in Solution—between 10 and 800 std. cu. ft. per reservoir barrel
Oil Saturation—between 10 and 40 percent of the pore space
Porosity—between 15 and 30 percent Whether these reservoirs will be feasible for a mining process will be a function of the product of the formation thickness, formation porosity and residual oil saturation.

Oil in Place = Area × Thickness × Porosity × Oil Saturation. Factors of depth and mineability of formations above or below the oil zone itself will be major factors in the economics or feasibility of any such process.

The reservoirs which have undergone primary depletion only, with or without steam stimulation, will normally contain a much higher percentage of inplace oil at the time any mining process may be initiated.

These reservoirs will normally contain a more viscous oil, be at relative low pressures, and at relatively shallow depths. These reservoirs are represented by the higher viscosity oil reservoirs in California, Venezuela, and in Canada. They are presently being produced but with great difficulty. There is probably over 500 billion barrels of oil in this class of reservoir in the world.

Virgin reservoirs which might be susceptible to underground mining are represented by the known tar sands and the very viscous or high pour point oil deposits throughout the world. It is known that very extensive reserves of petroleum exist in these type of deposits in the United States, Canada and South America. The estimated reserve is 1,000 billion barrels. These virgin deposits are susceptible to both strip mining and to some types of underground recovery.

The "tar" sands which are being produced in Canada by means of strip mining have been drilled and tested by conventional petroleum recovery mechanisms with very little success. The petroleum content of these "tar" sands change into a very viscous oil with depth. They have not been treated with combinations of known recovery technology in order to make them productive. They have been overlooked as a potential source of petroleum production primarily because of the quality of the petroleum and their location. In many cases these reservoirs represent a petroleum deposit which is directly mineable by surface methods. As the depth of these deposits increase, the contained petroleum is very highly viscous and has gas in solution so that removal of the petroleum containing formation is not possible because of gas release to the atmosphere in the pit and the resultant ventilation and fire-explosion hazard.

It is believed that using available mining technology it is possible to develop mine working preferably beneath the oil-water contact of certain oil fields in selected areas. By being below the oil-water contact, it should be possible to hold the greatest hazard to mining, the inflow of any of the gasses normally associated with oil production, to an acceptable minimum. The other important limiting criteria include the following items:

(1) Rock Characteristics for Mine Workings

If mine workings are to be developed below an oil-water contact, it is likely that the workings must be in a formation which is highly competent with very low permeability such as a shale or dense limestone, or at least with such a stratigraphic unit acting as a seal against uncontrolled inflow of fluids from the producing reservoir. At least in the early stages of oil recovery by mining, fields with minimum faulting should be developed, again, to aid in control or elimination of unexpected gas and water inflows.

Since shales are relatively incompetent and often tend to "flow" or "squeeze" to fill mine workings, thus causing expensive support problems, it is estimated that development in shales should be limited to depths of 1200 feet or less. However, circumstances may exist where a much greater depth can be worked.

Limestones are more competent. It is estimated that in general, with acceptable levels of support requirements, it should be possible to develop mine workings, under oil, reservoirs, in limestones or dolomites to depths of at least 4000 feet. Again, circumstances may exist where a much greater depth can be worked.

Probably mine development within a salt unit would be the ideal. In this case, the salt would be an excellent seal against water inflow, it is easily cut by conventional mining equipment, and it is possible that the salt produced in the development of mine workings could be marketed. The flow characteristics of salt would limit the depth of working possible without excessive support problems.

Sandstones may or may not be a desireable medium for mine development. Such things as permeability and porosity, gas, oil or water content, and strength of the formation would be major limiting factors, as well as stratagraphic features of the formations above and below the sandstone.

(2) Reservoir Temperature

In general, men can work in mine workings in rocks with temperatures up to about 125° F. At temperatures above this, cooling is possible but may or may not be economical.

(3) Quality of Crude

Two important considerations suggest that reservoirs with higher quality crude, roughly defined here as higher than 30° API, should be the target for oil mining. The lower gravity crudes, 8°–12° API, are worth less than a barrel of 50° API crude. This indicates the payout for high quality crude will likely come much earlier than for the lower quality crudes. The only reason for any question in this regard is the needed estimate of size or reserve versus mining cost. This will have to be developed for each individual case. Higher quality crudes, with contained lighter fractions, are likely to be more mobil in a reservoir than are the low gravity crudes.

(4) Pour Point

The reservoirs planned for mining of oil should contain crudes with low pour points although this is not a limiting factor. There are systems available, one in particular that has recently been publicly announced, that will permit in-place controlled heating of a reservoir. It will be possible to heat the reservoir uniformly in blocks extending for several hundreds of feet. The temperature can be raised several hundreds of degrees, if necessary, within a few weeks time. Such heating would fluidize high pour point crudes, or in other cases, could be used to increase gas pressures within a reservoir, thus tending to re-establish a natural gas drive within the reservoir. In the few cases of higher gravity oil, lower rock temperature and higher pour point, heating of reservoir, with development and production through mine workings could be an excellent solution to an otherwise non-producible field.

(5) Thickness of Pay Section

The thickness of pay section should be as great as possible. This would simply allow more reservoir development per foot of mine workings, thus reducing the development cost per barrel of oil produced.

(6) Depth of Pay Section

It is hoped that the first oil mines can be developed in reasonably shallow fields, that is at depths of 1000 feet or less, to hold down development costs and to permit more easily handled rock conditions for mine development. The reservoir should be deep enough that natural water and/or gas drives, to the extent possible in a depleted field, could still be utilized.

(7) Porosity

Target reservoirs must have sufficient oil-saturated porosity, with enough oil remaining after production by surface well methods, to make the reservoir a potentially economic target. Data for this determination should be available for any developed field, in varying degrees of completeness. Probably this type of data will be less complete or useable for the earlier discovered field, which may also be the best targets for initial oil mining.

Limestones may range in porosity from zero to cavernous. In more cavernous limestones, porosity at the well may be essentially zero while a short distance away a large untapped oil reserve may exist. Limestone reservoirs, overlain and underlain by competent formations are fairly prevalent in the Appalachian states, West Texas and New Mexico. Many of these reservoirs contain large quantities of hydrocarbon material, but the recovery, either by primary or secondary methods, is usually extremely small. These formations have not behaved as existing petroleum engineering theory predicted, hence it is believed that a tremendous amount of oil is still present in most of these limestone formations. More complete opening of the reservoir by mining techniques may provide the "permeability" that appears to be lacking in the porosity.

(8) Permeability

In normal well production, permeability, the interconnection between points of oil-containing porosity, is essential. For oil mining, higher permeability reservoirs would be desireable in sandstone reservoirs. Within limestone reservoirs, particularly those that tend to be cavernous, more complete development of the reservoir, may permit much more complete recovery from these reservoirs.

(9) Other Characteristics

Other oil and reservoir characteristics, such as viscosity, pressures, gas in solution, sulfur content of the oil and $H_2S$ percentage in gas, uniformity of reservoir vertically and horizontally to name but a few, will all be important characteristics, but are not thought to be as important as those listed separately above.

Advantages of Oil Mining

There are several advantages offered by oil mining which are as follows:

1. This is a possible way of placing "wells" on approximately one acre spacing or less, providing a much greater possibility that oil entrained in the reservoir will move to the well.

2. Natural gas and/or water drives can be utilized.

3. By drawing from the bottom, gravity can be used to the maximum effect.

4. Drill holes for each well are much shorter than those drilled from the surface and hence less expensive per well while the cost of the access shaft and tunnels can be amortized over a large number of wells.

5. No pumping equipment at each well would be needed but only at the bottom of the shaft for all wells.

6. Currently, depending upon the company, discovery of new oil costs from $4 to $7 per barrel. Since the mining development would be within known fields there would be no cost of discovery. It is thought that the saving from this cost alone could pay most if not all of the development and production costs.

7. Landowners would already be familiar with oil production and its benefits. Perhaps they would be reasonably receptive to oil mines being developed in their area.

8. If there has been production from the field, perhaps useable surface pipelines to refineries might be reasonably close.

The concept of applying mining techniques to the production of oil from oil bearing sands, both virgin and depleted, is both old and well known as described in a United States Bureau of Mines Bulletin No. 351 entitled "Mining Petroleum By Underground Methods" by George S. Rice published by the U.S. Government Printing Office in Washington, D.C. in 1932. Methods for the underground mining of oil were further investigated and reported in a bulletin entitled "Mining For Petroleum: Feasibility Study" prepared for the U.S. Department of the Interior—Bureau of Mines under contract No. JO275002 July, 1978. These prior art publications while informative, do not include sufficient specific details of how to go about overcoming the many practical problems encountered in the underground mining of petroleum. To overcome this deficiency the present invention was devised.

SUMMARY OF INVENTION

It is therefore a primary object of the invention to provide new and improved techniques and equipment for the practical underground mining of petroleum from both virgin and depleted oil fields under certain geological conditions where such mining of oil is feasible.

In practicing the invention, a method of drilling a relatively small diameter drainage-type mine oil well using a fluid and cutting control assembly, is provided. The fluid and cutting control assembly comprises a stop valve mounted on a pipe casement for securement to a firmly anchored collar pipe providing the outer liner for an access opening to a drainage-type mine oil well. The drainage-type mine oil well is drilled into the overlying roof of a tunnel cut into a competent rock zone below oil well sands containing unrecovered oil. The gate valve and pipe casement have an inside diameter opening with the gate valve in the open condition which is sufficient to accommodate the outside diameter of a drainage-type mine oil well production conductor pipe and/or a drill bit and drill string together with appended stop valve, coupling and the like required to support the drill string or production conductor pipe. Upper and lower blow-out preventers are secured to the casement below the stop valve and have internal diameters sufficient to accommodate the external diameter of the drainage-type mine oil well production conductor pipe and/or the drill string fitting for the drill bit. An upper drain vent control valve is connected to a first drain vent branch pipeline and to the casement between the stop valve and the upper blow-out preventer. A lower drain vent control valve is connected to a second drain vent branch pipeline and to the casement intermediate to the upper and lower blow-out preventers. With the fluid and cutting control assembly in place mounted on the annular collar, a drill bit and supporting drill string is inserted through the opened lower and upper blow-out preventers and through the opened stop valve. The small diameter gravity-type oil drain well is then drilled upwardly through the overlying competent rock roof of the tunnel and into the oil bearing sane zone to a desired depth while supplying cutting fluid to the drill bit under pressure upwardly through the drill string. During drilling, the upper and lower blow-out preventers are maintained tightened down on the exterior of the drill string to only a slide fit and cutting fluid and entrained cuttings are drawn off through the upper and lower drain vent control valve and the connected branch drain pipeline for supply through a piping system installed in the tunnel and to a pump for pumping to the surface and disposal.

Another feature of the invention is the provision of a method for installing oil well production conductor pipe in the relatively small diameter drainage-type mined oil wells after drilling in the above-described manner. The method comprises loosening the upper and lower blow-out preventers while withdrawing the drill string to the point where the drill bit is just below the stop valve while drawing off any fluid cutting oil and gas and water entrained in the fluid through the upper and lower drain vent control valve for removal to the surface in the above-described manner. The stop valve is then closed and the drill bit completely withdrawn from the fluid and cutting control assembly. A production conductor pipe is then inserted within the casement through the loosened upper and lower blow-out preventers to a point where the upper end of the conductor pipe is just below the stop valve. The blow-out preventers are then tightened to the point of providing only a slide fit for the exterior surface of the production conductor pipe while maintaining the upper and lower drain vent control valve open and under suction to drain off any leakage of fluid past the upper blow-out preventers. The stop valve is then opened and the production conductor pipe driven upwardly through the drilled opening into the oil bearing sand strata to a desired depth.

Another feature of the invention is the provision of a closure over the upper end of the relatively small diameter drainage-type oil mine well production conductor pipe during the emplacement thereof in the preceeding described manner together with selectively opening the upper end of the production conductor pipe after it is secured in place to a desired depth into the oil sand strata in order to place the well into production. To facilitate placement of the production conductor pipe with its upper end closed, the pipe is vented during emplacement and subsequent cementing into place. For this purpose, it is necessary to vent the space intermediate the drilled hole and the conductor pipe as it is being emplaced and cemented. To accomplish the venting, a small diameter flexible fluid impervious venting tube is supported through the interior of the conductor pipe while it is being emplaced and at the upper tip end thereof extends through a small port in the upper end of the conductor pipe. A control valve is secured in the venting tube at a lower accessible end of the tube so that it can be controllably opened and closed to control the venting through the tube. The discharge end of the vent tube is led through the tunnel back up through the access shaft to the surface in order that the mine atmosphere is not contaminated with gases vented through the venting tube.

Still another feature of the invention is the provision of a method for permanently cementing the production conductor pipe into place by first tightening down the upper and lower blow-out preventers to the greatest possible extend to prevent movement of the conductor pipe during cementing. Cement under pressure is then forced from a cement pump connected through the upper drain vent control valve and its interconnected first branch pipeline to the space surrounding the conductor pipe. During cementing the stop valve is in its fully opened condition so that it is not cemented into place and subsequently can be removed along with the fluid and cutting control assembly. To facilitate this operation, the space between the upper and lower blow-out preventers preferably is flooded with water during the cementing stage. After setting of the cement, the fluid and control assembly casement including the stop valve is removed and a new stop valve coupled to the end of the cemented in place production conductor pipe along with any additional lengths of production conductor pipe required to lead away the oil produced by the well to a suitable collection point within the mine tunnel system.

A still further feature of the invention is the provision of a method for opening the upper end of the production conductor pipe after it has been cemented into place. A preferred method is to attach a small charge of explosive to the closed upper end of the production conductor pipe and thereafter selectively detonating the charge to blow open the top of the conductor pipe and place it into production. An alternative method is to employ a Johnson Screen together with a suitable closure element such as a one way check valve disposed in the conductor pipe below the screen. A small charge of explosive should be attached to the closure element and a small remotely operated detonator secured to the charge for selectively detonating the charge and blowing open the closure element to place the oil well into production through the Johnson Screen. In the case of the Johnson Screen care must be exercised to assure that the cement is not allowed to rise sufficiently high to close the Johnson Screen. A further method is to employ a Schlumberger type perforating gun secured to the interior of the closed end of the production conductor pipe while it is inserted into place and thereafter remotely fired to perforate the upper end and upper sides of the production pipe in order to place the well into production.

BRIEF DESCRIPTION OF DRAWINGS

Other objects, features and many of the attendant advantages of this invention will become better understood upon a reading of the following detailed description when considered in connection with the accompanying drawings; wherein, like parts in each of the several figures are identified by the same reference character, and wherein:

FIG. 3 is a schematic drawing illustrating a preferred way of driving an enlarged diameter shaft of sufficient size to accommodate men and equippment through a competent rock zone to near the oil and gas bearing horizon, then providing an annular chamber by means of which small drift holes are drilled in an annular array around the intended path of the extended large diameter access shaft to permit freezing, grouting or otherwise stabilizing the oil-producing zone to permit sinking of the large diameter access shaft through it to a second lower competent rock zone into which access tunnels beneath the oil field can be drilled. FIG. 3 also illustrates the provision of a fluid impervious casing around the large diameter access shaft for the portion of the length thereof which extends through the oil bearing sand strata;

FIG. 4 is a schematic illustration of the manner in which a relatively small diameter drainage-type mine oil well is initially drilled through the roof of a tunnel formed in the underlying lower or second competent rock zone by initially placing a cemented in place enlarged diameter collar pipe in a larger diameter hole drilled upwardly through the roof of the tunnel so as to provide a solid anchor for a well hole collar pipe;

FIG. 9 illustrates still another alternative arrangement for perforating a production conductor pipe which has been sealed closed during its installation and emplaced within the oil bearing sand strata using a Schlumberger gun;

DETAILED DESCRIPTION OF BEST MODE FOR CARRYING OUT THE INVENTION

Figure 1:
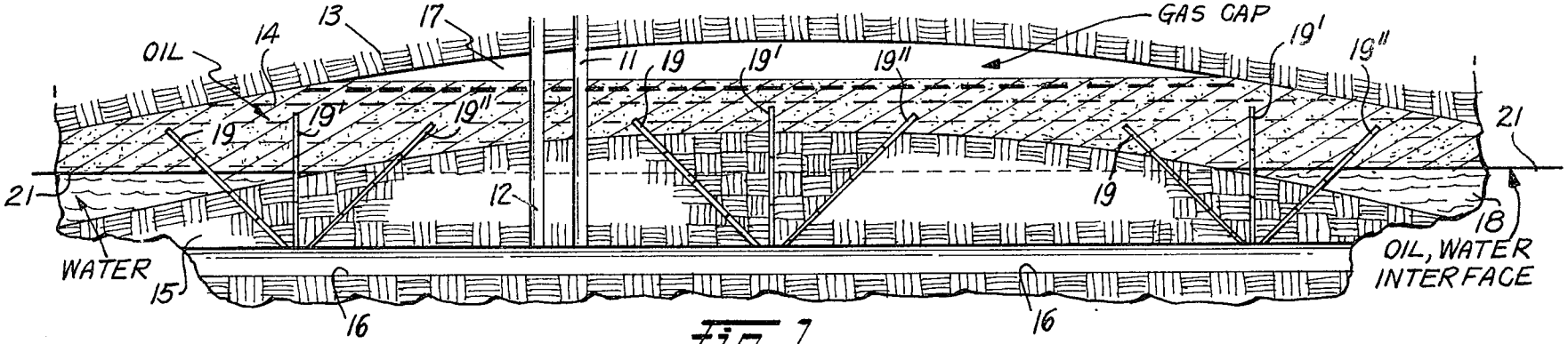
FIG. 1 is a schematic drawing illustrating the positioning of two access mine shafts through an oil bearing sand strata in such a manner that the shaft penetrates from an upper competent rock shelf, through a gas cap, through an oil bearing zone and down into a lower competent rock zone where access tunnels are provided for mining development of drainage-type oil wells within the tunnel system.

FIG. 1 is a schematic illustration of a typical layout for a mine development for the recovery of oil by mining. In FIG. 1, two relatively large diameter vertical shafts 11 and 12 which are of sufficient size to accommodate both men and equipment for mining beneath the ground have been driven through an overlying upper competent rock strata 13, through an oil bearing sand zone 14 and into a lower competent rock zone 15. The two vertical shafts 11 and 12 terminate in a horizontal tunnel indicated at 16 which likewise is of sufficient size to accomodate workmen and the equipment required for driving upwardly through the roof of the tunnel 16 a number of relatively small diameter, drainage-tupe oil production wells indicated at 19, 19' and 19" with the drainage-type oil production wells being placed at predetermined intervals along the length of the tunnel 16. It is anticipated that the tunnel 16 will interconnect with other horizontally extending tunnels (not shown) so that substantially a criss cross network of tunnels will be provided beneath the oil field depicted at 14. The drawing is illustrative of a typical geological condition wherein the oil field is capped by a gas cap indicated at 17 which at least at some time in the past pressurized the oil within the oil sands 14 as well as a layer of water indicated at 18 trapped between the lower competent rock strata 15 and the oil bearing sands 14. This results in the formation of an oil-water interface as shown at 21.

From FIG. 1 it will be seen that the vertical access shafts 11 and 12 for mine access must pass through the oil and/or gas bearing productive zone or zones all of which may be under pressure. The sinking of the vertical shafts under such conditions requires a system whereby all possible inflow of gas and/or oil will be completely controlled without danger to men and equipment working on and in the mine. The mine workings are to provide access preferably under an oil-water interface for drilling operations and the placing of the piping, for the removal of drill cuttings, any oil and/or gas encountered during the drilling of production wells in addition to providing for a piping system for transporting produced gas and oil from the wells. This in in addition to the normal mine drainage, ventilation, power and waste removal systems required in any mine workings. Preferably the development should be such that oil and gas production can be carried out either while mine development workings are going on to drive additional drainage-type oil wells as will be described hereinafter.

The mine shaft configuration shown in FIG. 1 employs two vertical access shafts since safety rules and regulations require two entryways to a mine. Thus the drilling cuttings removal and oil production system and piping can be placed in one of the vertical shafts for access to the surface and the other vertical shaft can be employed for personnel access and egress. It is desirable that the two vertical shafts be rotary drilled or sunk at a pre-set distance apart and the shafts securely sealed by fluid impervious liners through at least the oil and gas zones 14, and the two shafts extended down into the lower competent rock zone 15 where the ends of the shaft are interconnected through the tunnel 16. Shaft 11 can then be used for ventilation exhaust, removal of production drill hole cuttings, produced gas and oil and removal of mine wastewater as well as to provide an escapeway if necessary. Shaft 12 can be the main mine development shaft carrying the ventilation inflow, any electrical systems for supply of electricity to equipment required below as well as all other services needed for developing the mine.

Figure 2:
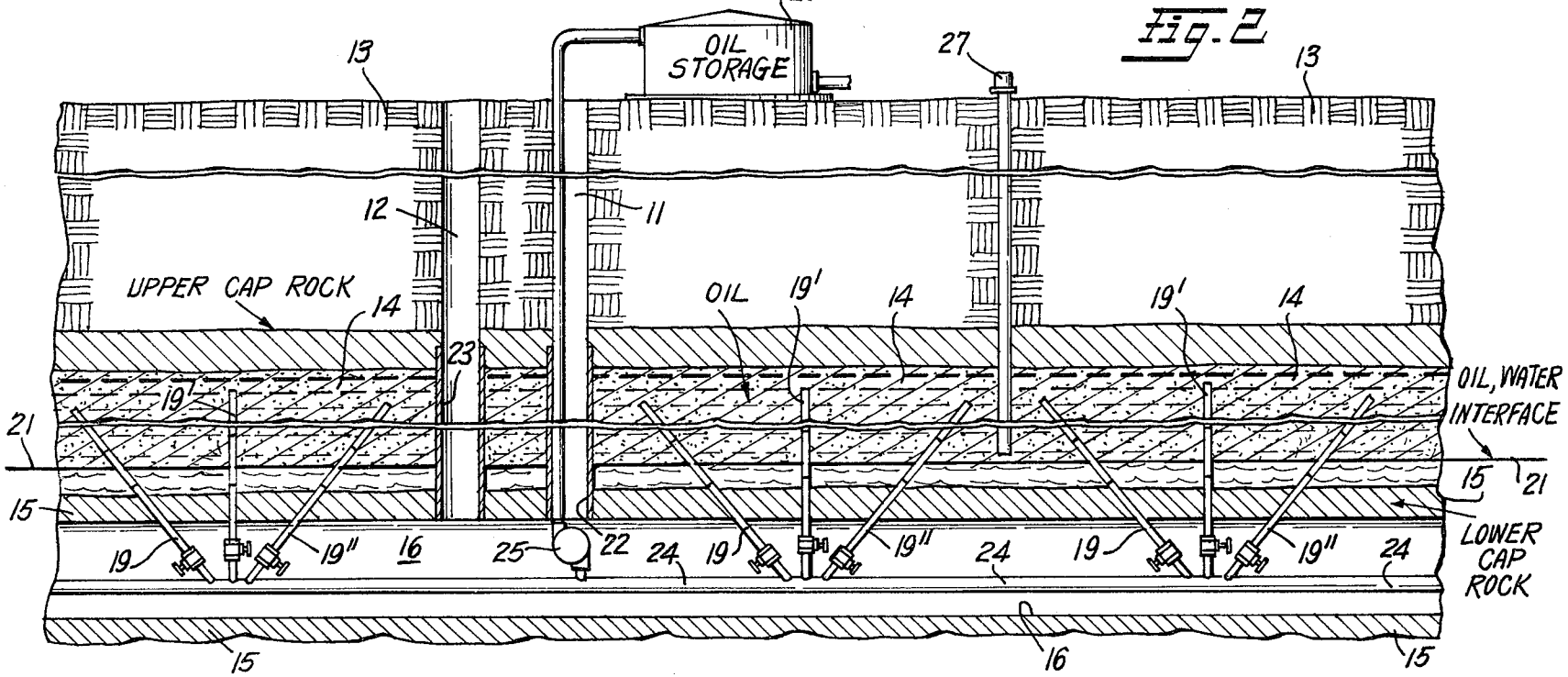
FIG. 2 is a more detailed schematic drawing of an oil field being mined according to the invention but which has no gas cap and illustrates the manner in which drainage-type production oil wells are connected to collection lines leading to a vertical access shaft where the oil is pumped to the surface for storage.

FIG. 2 illustrates an installation quite similar to that depicted in FIG. 1 but shows in greater detail the fluid impervious liners 22 and 23, respectively, for the vertical access shafts 11 and 12 which extend through the oil and gas bearing zone 14. FIG. 2 further illustrates the collection piping system 24 laid through the horizontal tunnel 16 which interconnects the production conductor pipes 19, 19' and 19" at the plurality of drainage-type mine oil well sites to a pump 25 at the base of vertical access shaft 11 which pumps the collected oil and gas to an oil storage tank 26 on the surface. The installation shown in FIG. 2 does not include a gas cap but does include an oil-water interface shown at 21. For this reason, the lengths of the small diameter gravity-type drain oil well pipes 19, 19' and 19" are extended above the oil-water interface. Because of the height of the oil-water interface it is possible that there may have been existing surface oil wells such as the one indicated at 27 driven into the field which are no longer sufficiently productive to justify further working. In such instances the abandoned surface oil wells could be capped as indicated or alternatively could be used as a means for introducing secondary treatment agents such as hot steam, compressed gas, water, etc., to increase working pressure within the oil sand strata. In addition to such measures, one or more of the individual gravity-type oil production conductor pipes 19 at different locations along the length of the access tunnel could be disconnected from the main collection pipe 24 and instead connected to a secondary treatment agent supply pipe 28 such as shown in FIG. 8A of the drawings in order to introduce such secondary treatment agents into the oil bearing sand strata at different selected sites along the length of the access tunnels.

Figure 2A:
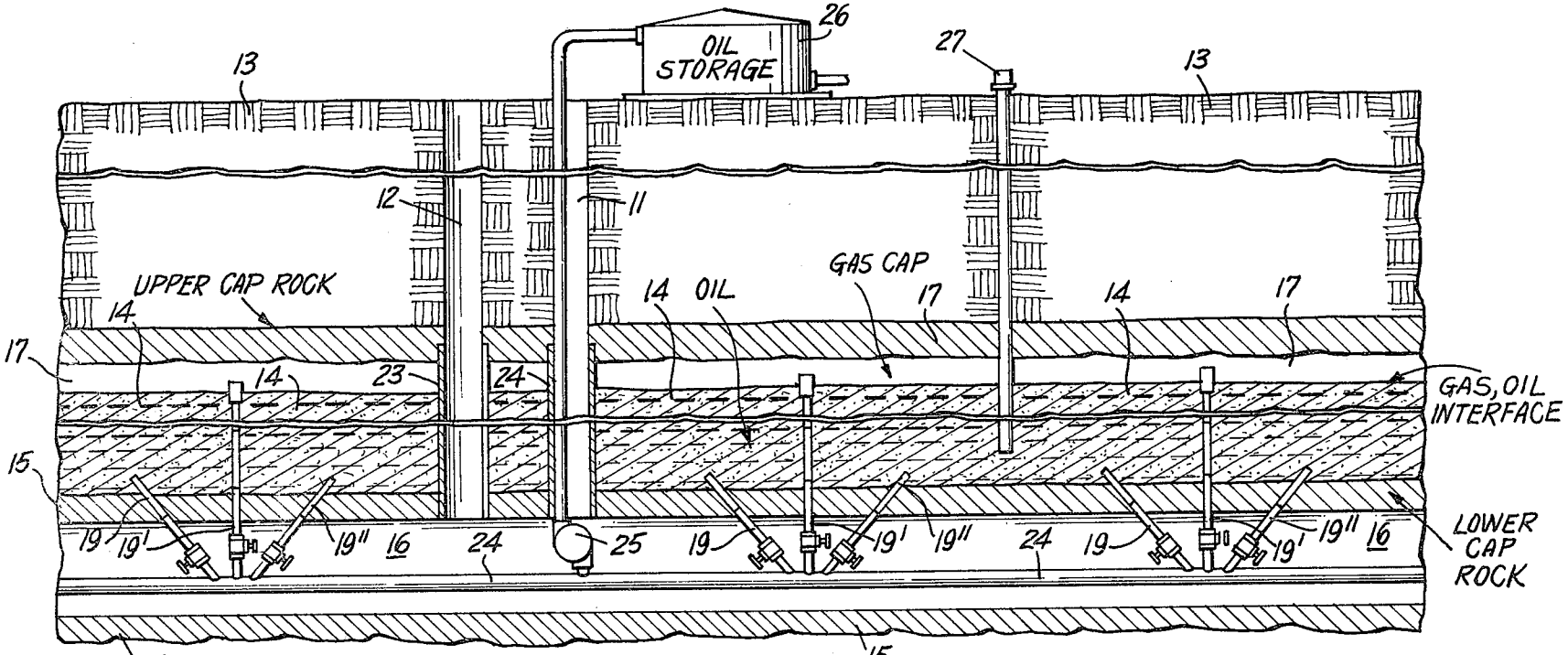
FIG. 2A is similar to FIG. 2 except that it depicts an oil field wherein a gas cap is present in the strata.

FIG. 2A is a view similar to that shown in FIG. 2 but illustrates instead a geological installation wherein there is a gas cap 17 interposed between the upper cap rock 13 and the oil bearing sand strata 14. In such installations it may be desireable to provide drain oil well production conductor pipes such as 19' of sufficient length to reach into the gas cap 17 for the purpose of controlling pressure induced by the existence of the cap. For this purpose, the extended lengths of production conductor pipes such as 19' could be used to bleed off certain of the gas pressure in the gas cap to maintain it below certain predetermined levels or alternatively, such extended lengths of pipe could be connected to pressurized gas sources for increasing the pressure within the gas cap for improving production from the other adjacent drainage-type oil mine production conductor pipes such as 19 and 19" or those located further along tunnel 16.

The existence of a gas cap such as shown at 17 in FIG. 1 and in FIG. 2A would tend to complicate the process of driving a large diameter access shaft such as 11 or 12 down through the upper cap rock 13 into and through the oil bearing sand strata and thence down into the lower cap rock 15. The gas cap zone would be relatively free of water or oil and thus would probably not respond to freezing techniques and may not react satisfactorily to grout. If such conditions are indicated by prior exploration and evaluation, it is likely that rotary drilling of the shaft, using conventional oil well drilling needs and techniques, would be indicated. Shaft casing can be floated on the mud, down into position, and cemented, perhaps using the same technique as was used in lining the U.S. Bureau of Mines deep shaft through oil shale near Rio Blanco, Colo.

Where gas cap danger is not indicated but it will be necessary to sink the shaft through an oil and/or water saturated formation, the shaft can be sunk by any conventional sinking procedure to a safe depth below the oil-bearing zone 14. At this particular level, an annular chamber shown at 28 is mined in the upper competent cap rock 13 so as to completely surround the shaft location 11. From the floor of the annular chamber 28, a number of very small diameter drill holes are drilled completely around the circumferance of the path of the projected vertical access shaft 11 as shown at 29. The vertical drill holes 29 are then supplied with a suitable solidfying agent such as grout, cement, silicon fluoride or the like or alternatively may be supplied with a suitable refrigerant for freezing the oil sands 14 within the region of the projected path of the vertical access shaft. The vertical access shaft is then drilled through the solidified gas and oil bearing sand region and sides of the shaft in this region are lined with a suitable fluid impervious liner 23 or 24 as described earlier with respect to FIGS. 2 and 2A of the drawings. The drill holes 29 must be positioned so that the temperature of the oil and gas zones 14 can be lowered below the freezing point of water and pour point temperature of the contained oil. As noted above, freezing may be replaced by the use of any of the several possible grouts including but not limited to AM-9 manufactured and sold by American Cyanamide, silicon fluoride or cement grouting. In the event that the oil and gas region 14 is quite shallow and close to the surface of the earth, the drill holes 29 could be drilled from the surface in a similar manner in order to solidify the projected path through which the vertical access shaft must be driven. After the oil and gas bearing zone 14 has been frozen or otherwise stabilized, the shaft 11 can be driven, using gassy mine techniques through the oil and gas bearing zone 14 down to and through a portion of the lower competent cap rock region 15. If desired, a suitable sump such as shown at 31 can be provided at the base of the vertical access shaft.

The development of the mine workings using vertical access shafts 11 and 12 drilled in the above briefly described manner, can be on whatever pattern appears appropriate as dictated by cost analysis of the geology of the particular oil deposit being mined. The mine workings are solely for the purpose of providing access for drill site locations for the relatively small diameter drainage-type oil wells to be drilled upwardly into the overlying competent cap rock roof of the access tunnel 16. The location of the drainage-type oil well sites along the lengths of the access tunnel will be determined primarily by the following basic factors:

(a) Competence and impermeability characteristics of the host rocks in which the access tunnel 16's have been bored.

(b) The location of needed drill sites as determined by the nature of the oil deposit.

(c) Ventilation requirements.

(d) Optimum scheduling permiting simultaneous continued mine development, drilling of production wells and completion and production from producing wells.

(e) Accomplishing the above with the least possible complexity of the mine workings.

Since each oil field is different from all others, the above analysis undoubtedly will result in different mine layouts for each field. As previously noted, the mine workings simply are to provide continuous access to the producing drain oil wells, a way of removing waste during mine development and any that may develop later and to provide passageways for the positioning of production pipelines for removal of produced oil and gas. The mine workings in the form of the access tunnels can be driven by known underground mining drilling-blasting-muck removal techniques and by the utilization of horizontal tunnel boring systems with or without hydraulic jet assist. Whatever system is used, it will be advantageous in the environment noted to keep fracture of the raw rock around the tunnels to a minimum in order to assist in prevention of undesired leakage from the overlying oil and gas horizon. Also it is anticipated that all of the small diameter drainage-type mine oil wells such as 19, 19' and 19'' within the mine workings would be tied into central piping systems designed to optimize both manual and automatic production control of oil and gas through the well head.

Referring to FIG. 4 of the drawings, a cross section of one of the access tunnels 16 is illustrated with the cross section being taken through a drainage-type oil mine well site. At the well site, a hole shown at 32 is drilled upwardly through the overlying roof 15 of access tunnel 16 at any angle upward through only a portion of the competent rock cap surrounding access tunnel 16. The hole 32 is drilled to a depth great enough to permit solid cementing into place of a collar pipe 33. The collar pipe, for example, may have a diameter from about 6 to 8 inches more or less depending upon the desired diameter for the gravity-type drain oil wells to be installed at the site. A shoe flange shown at 34 is threaded over the lower threaded end 38 of collar pipe 33 in order to close the space between the outer surface of collar pipe 33 and the inside of the drilled hole 32. Cement is then supplied under pressure to this space via cement ports 35 formed in the end of the collar pipe above the threaded end 38 and a cement gun nozzle shown at 36. After cementing, the cement gun 36 is removed and the ports 35 closed with suitable stoppers while the cement 37 sets. After the cement 37 has set, so as to firmly seal collar pipe 33 into place in the drilled hole 32, the shoe flange 34 can be unscrewed and removed.

Figure 5:
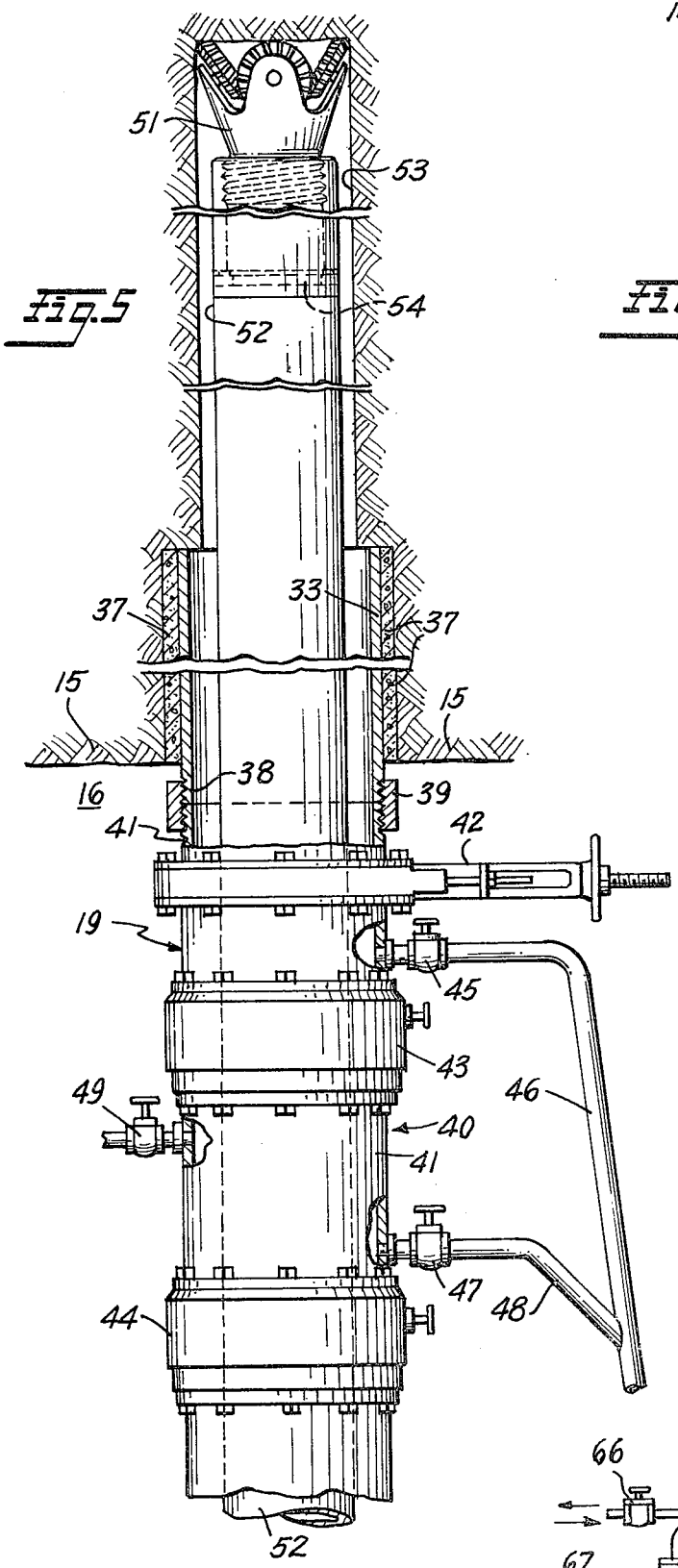
FIG. 5 is a schematic, side sectional view of a fluid and cutting control assembly employed in practicing the invention and shows the same installed in place on a drainage-type mine oil well being drilled in the roof of one of the access tunnels to permit the drilling of such wells within the mine without contaminating the mine workings atmosphere.

With reference now to FIG. 5 of the drawings, the cemented into place collar pipe 33 has a coupling 39 screwed onto its lower threaded end 38 for coupling to the collar pipe 33 a fluid cutting and control assembly shown generally at 40. The fluid cutting and control assembly 40 is comprised by an outer casement 41 which in fact may be made up of different segments which include a manually operated stop valve 42 which may be of the well known, commercially available gate valve type, an upper blow-out preventer 43, a lower blow-out preventer 44, an upper drain vent control valve 45 connected to the casement 41 intermediate stop valve 42 and the upper blow-out preventer 43 and a lower drain vent control valve 47 connected to casement 41 in the space between upper and lower blow-out preventers 43 and 44. The upper and lower drain vent control valves 45 and 47 are connected through respective branch pipelines 46 and 48 to a suitable trunk pipeline that carries fluids used during drilling, any entrained oil, gas, rubble and the like away through a suitable mud pump (not shown) for transport through a conduit laid down through the access tunnels and vertical access shaft up to the surface and discharged to a suitable collection point. Where it is desired to use the fluid and cutting control assembly 40 repeatedly at different well sites, a third drain vent control valve 49 is provided together with an interconnected branch pipeline for connection to the same discharge conduit system. The purpose of the third drain vent control valve 49 will be described more fully hereafter with relation to FIG. 6 of the drawings.

The drain vent control valves 45, 47 and 49 are entirely conventional and available commercially, and hence need no further description. Likewise, the piping, collar pipe, casement segment, couplings, flanges and the like are believed to be entirely conventional and commercially available and require no further description. The stop valve 42 and upper and lower blow-out preventers 43 and 44 similarly are conventionally available items obtainable from oil field equipment supply firms such as the Hydril Co. of Los Angeles, Calif., the Gardner Denver Corp., the Grinnell Valve Co. and the Jamesbury Corp. These items must be of sufficient size so that their inside diameters will accommodate passage through the centers of the equipment and valves of the outside diameter of a drill bit 51 and its associated supporting drill string 52, couplings between segments of the drill string and a one-way flap or check valve 54 which is mounted at the top of the drill string 52 immediately under the drill bit 51. The flap valve 54 which is set in the first section of the drill string or drill pipe 52 supporting drill bit 51 permits drilling fluid such as water under pressure to flow upward around the drill bit 51 to facilitate drilling but will check or stop any back pressure to the drill string 52 and prevents any backflow of such fluid down through the inside of drill pipe 52 when the drilling fluid input is discontinued.

With a drilling rig such as manufactured by Joy Manufacturing Co. or Boyles Bros., set up in the manner shown in FIG. 5, the drill bit and its supporting string is inserted through the fluid and cutting control assembly 40 by loosening the blow-out preventers 43 and 44 and opening the stop valve 42 to allow passage of the drill bit 51 and its supporting string up through the casement 41 to the end of the hole in which the firmly anchored collar pipe 33 is cemented. The blow-out preventers 43 and 44 are then tightened down to just a slide fit, drilling fluid is supplied to the inside of the drill pipe 52 and the drain vent valves 45 and 47 opened to drain off the drilling fluids and any entrained solid matter contained in such drilling fluids. If desired, a suction can be placed on the drain conduit connected to the branch pipelines 46 and 48 via a suitable mud pump of the type sold by Ideco or Envirotech (not shown) connected to the conduit for pumping the fluids back up to the surface and discharged. During drilling in a conventional fashion, the check valve 54 will prevent any backflow of fluids, gas, or other matter due to encountering a high pressure pocket as drilling proceeds. The drilled oil well drainage hole 53 then is drilled upwardly through the roof of the overlying competent rock shelf 15 out into the oil bearing sand strata as described previously with respect to FIGS. 1, 2 and 2A of the drawings.

Figure 6:
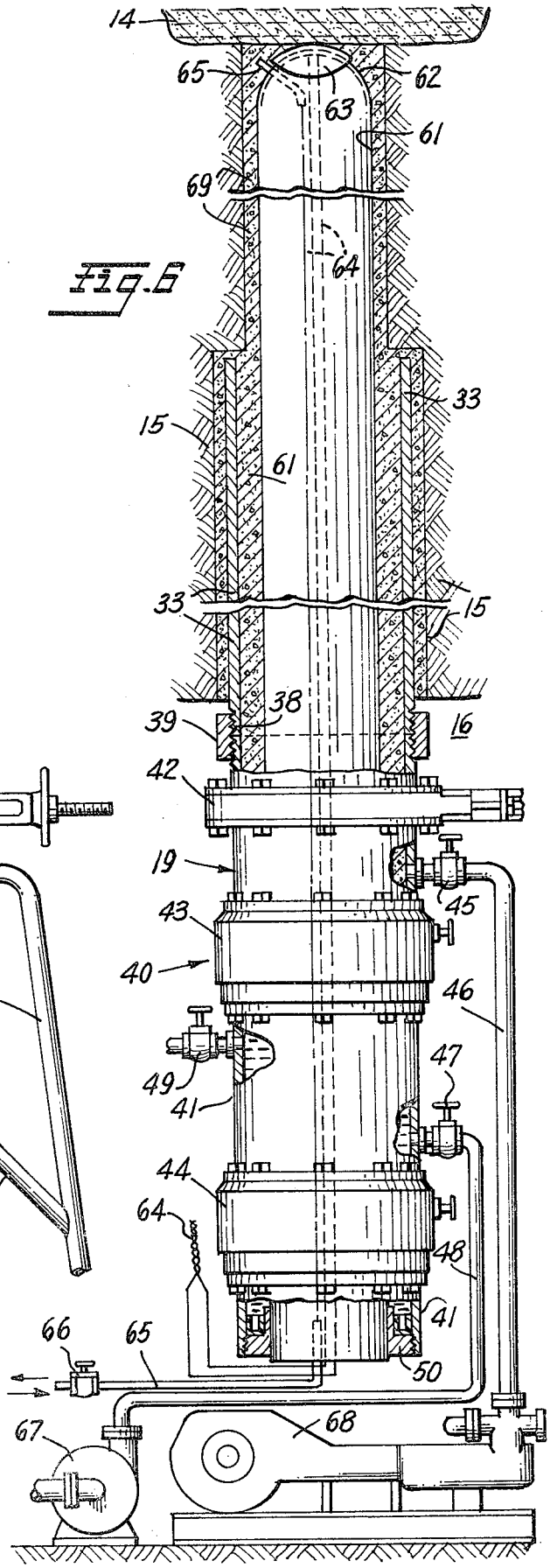
FIG. 6 is a schematic elongated side sectional view similar to FIG. 5 illustrating the manner in which a production conductor oil pipe for a drainage-type mine oil well is cemented into place employing the fluid cutting and control assembly.

After drilling of the oil well hole 53 at a particular site has been completed to a desired depth, the drill rig is then withdrawn from the hole. To facilitate this operation, as well as the drilling operation, it is anticipated that the drill string 52 will be coupled to drill bit 51 in segments which would allow its handling within the confines of access tunnel 16. For this purpose, the drill string is withdrawn until the drill bit 51 is just below the stop valve 42. At this point in the withdrawal of the drill string, the stop valve 42 is closed so as to hold off any back pressure that otherwise might force gas, oil, water, or other rubble down into the access tunnel 16. The drill string is then withdrawn completely by loosening the blowout preventers 43 and 44 and from this point on further withdrawal of fluids through the drain vent valves 45 and 47 and their interconnected branch pipeline would cease. An oil production conductor pipe 61 shown in FIG. 6 of the drawings is then mounted for emplacement in the previously drilled oil well hole 53. The oil production conductor pipe 61 likewise will be inserted into the hole in suitable length segments so that it can be handled within the confines of the access tunnel 16. As best shown in FIG. 6, the topmost segment of the conductor pipe 61 has its end 62 completely closed so that after it is inserted in place in hole 53 and cemented as shown at 69 in a manner to be described more fully hereafter, it will prevent the passage of any oil, gas, water or other fluid down through the conductor pipe until it is desired to commence production from the oil well site.

In order to insert the oil production conductor pipe 61 into place, the blow-out preventers 43 and 44 are loosened and the topmost segment of the conductor pipe 61 inserted in the fluid and control assembly 40 to a point where the closed end 62 of the topmost segment of conductor pipe 61 is just below stop valve 42. At this point the blow-out preventers 43 and 44 are tightened down to just a slide fit so that the conductor pipe 61 can be lifted upwardly through hole 53 segment by segment until it reaches the desired depth into the oil bearing sand zone 14 as shown in FIG. 6. At this point, the blow-out preventers 43 and 44 are tighted down to a firm grip and water under pressure is supplied from a water pump 67 which may be somewhere in the tunnel system or possibly even on the surface through the branch pipe 48 and vent control valve 47 to the space intermediate conductor pipe 61 and casement 41. The space between the outside surface of the oil conductor pipe 61 and the inside of casement 41 is then flooded with water under pressure between upper and lower blow-out preventers 43 and 44. During this flooding, the air in the space is vented through the third vent and control valve 49 until water passes through the valve and then the valve is closed so that the space can be pressurized with water. As a backup, a retainer collar 50 may be threaded into the end of the casement 41 below the lower blow-out preventer 44 so as to completely seal off the possibility of water seeping past the lower blow-out preventer and down into the tunnel space 16. Alternatively, it may be desired to also flood this space by slackening the lower blow-out preventer 44 until the space is filled and pressurized to the same extent as the upper space and then retightening the lower blow-out preventer. By this means, cement will not be allowed to enter into the fluid and coupling assembly so that it can be removed and reused at different oil well sites in the tunnel.

With the production conductor pipe 61 in place and the fluid and control assembly 40 flooded in the above-described manner, a cement pump 68 is coupled through the branch pipeline 46 and drain vent control valve 45 to the space between the entire extent of the production conductor pipe 61 and the inside of the oil well hole 53 above the stopped down upper blow-out preventer 43. At this point the stop valve 42 is in the fully opened condition so that cement provided through the upper fluid vent control valve 45 is allowed to pass upwardly into the space. During cementing, gas or fluids in the space above the cement level as it rises in the space intermediate the sides of hole 53 and the exterior surfaces of conductor pipe 61 is vented if necessary through a suitable fluid impervious vent pipe shown at 65 which extends out of a port in the closed upper end of the upper production conductor pipe segment 61. This fluid impervious vent tube 65 extends down through the interior of the conductor pipe 61 along with suitable detonator wire 64 for detonating a charge of explosive 63 attached to the upper closed end 62 of conductor pipe 61. The vent tube 65 leads down through a vent tube control valve 66 which may be located remotely on the surface or at some other accessible point in the mine working system where it is safe to locate the valve and may be even right at the base of the oil well site being worked upon as shown in FIG. 6. As cementing takes place and cement rises upwardly around the production conductor pipe 61, venting of the space in this manner will facilitate the cementing process. After cementing has been completed, the upper drain vent control valve 45 may be closed down and the cement allowed to set so as to assure firm anchoring in place of the oil well production conductor pipe 61.

Figures 7, 8B:
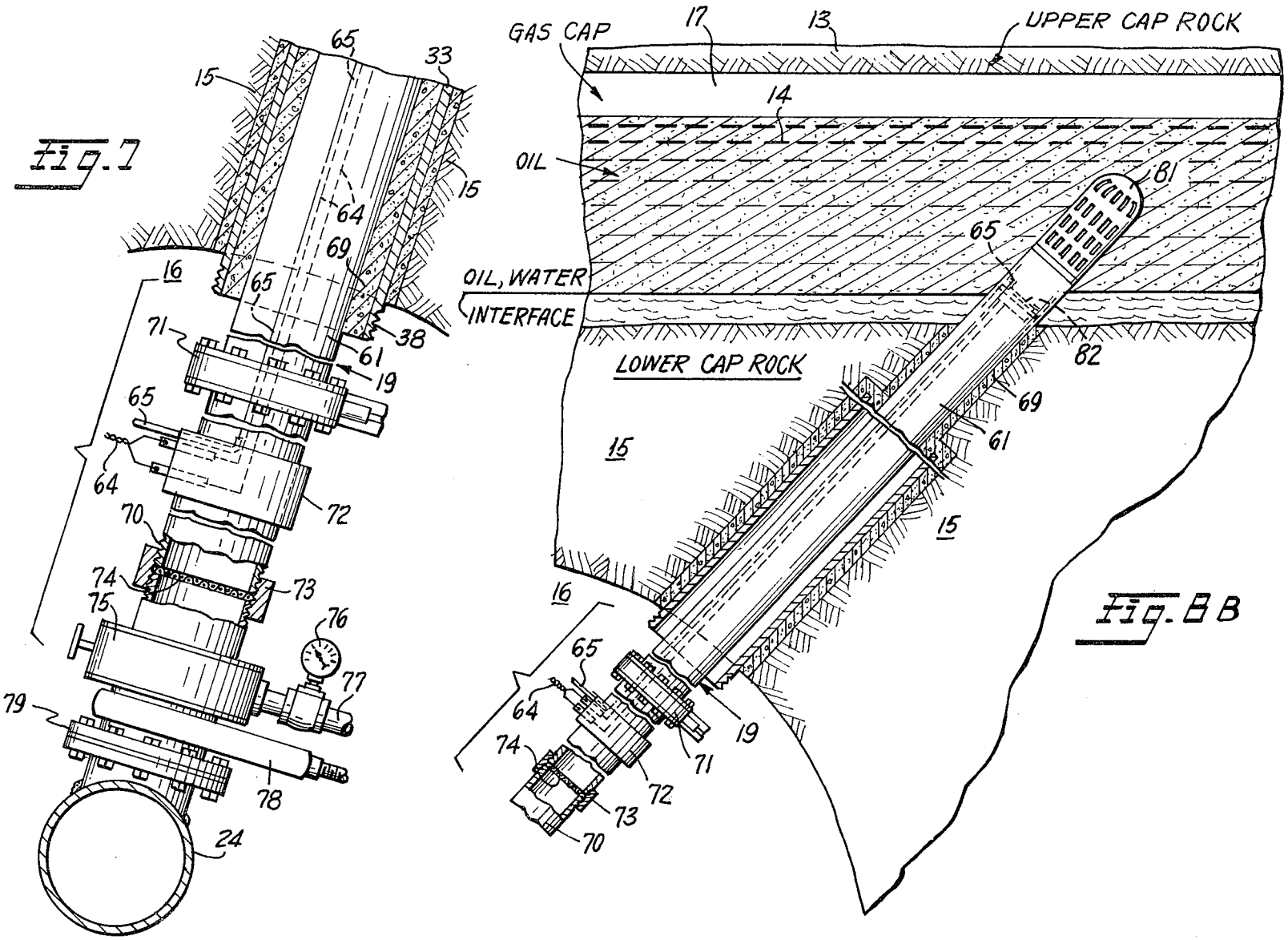
FIG. 7 is a partial elongated sectional view of a cemented-in-place production conductor pipe for a drainage-type mine oil well after it has been processed according to FIGS. 5 and 6 and showing different types of stop valves, screens, detonator control circuits, flow control valves as well as other measuring instruments, and the connection of the cemented-in-place oil well conductor pipe to an oil collection piping system that runs through the mine tunnel for accumulating oil drained from a multiplicity of different drainage-type oil wells placed along the length of the tunnel.
FIG. 8B is a schematic, elongated sectional view of a somewhat different form of drainage-type oil well emplaced in a mine according to the invention which uses a Johnson Screen and also incidentally shows a geological installation where there is a gas cap over an oil bearing sand strata which in turn has an oil/water interface below the oil bearing sand.
Figure 8A:
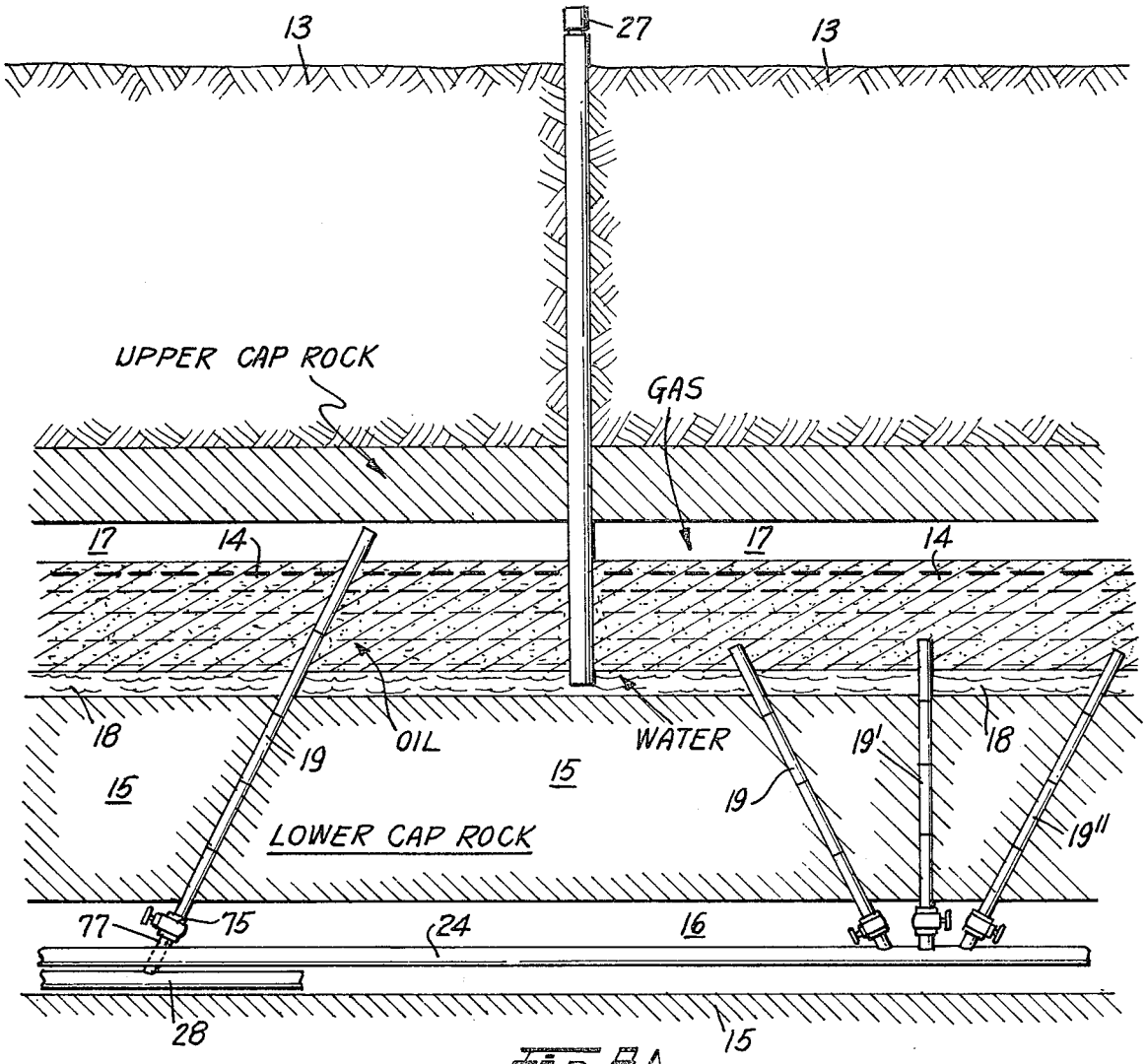
FIG. 8A illustrates a modification of the installation shown in FIG. 2 wherein certain of the relatively small diameter drainage-type oil well production conductor pipes are connected to a supply line for supplying secondary treatment fluids such as steam, compressed air, water or other fluid for pressurizing particular points along the length of a tunnel to improve collection at different points within the tunnel or within the depth of the field having another tunnel or tunnels beyond the pressurization point in the same plane.

FIG. 7 of the drawings shows the final production conductor oil piping installation after the cement 69 has set and firmly anchored the segments of the conductor pipes 61 extending through the tunnel 16 roof. After cement 69 has set, the water within the casement 41 between the upper and lower blow-out preventers 43 and 44 is drained out via the lower drain vent control valve 47 and pump 67 which may be a reversible pump or alternatively connected through a branch pipeline to a single acting pump used to reverse flow of water through the casement section and branch pipeline 48. Following this, the entire fluid and cutting control assembly 40 is removed including the interconnected branch pipelines 46 and 48 and the stop valve 42. Following this step, a new segment of conductor pipe indicated at 70 is coupled to the end of the cemented conductor pipe 61 protruding beyond the end of the cemented section 69 by means of a coupling (not shown) which may be of the type indicated at 73. In this additional segment of production conductor piping a stop valve 71 is provided which may be of the conventional gate valve type available from any oil field equipment manufacturer or supply warehouse. Also included in the additional conductor pipe segment at this point is a detonator control assembly shown at 72 which is connected via the wires 64 to the detonator for the explosive charge 63 in the capped end of cemented conductor segment 61. This portion of the installation will be removed following the blowing open of the top end or head of conductor pipe segment 61 as described hereafter. Below the detonator control assembly 72 a fairly strong screen shown at 74 is inserted in the pipe segment 70 by means of coupler 73 so that it can catch blasting wires 64, the venting tube 65 and other any assorted rubble that may result from the blast of the detonator charge 63 which places the oil well into production. Similar to the detonator control assembly 72 the screen 74 and any assorted rubble caught in the screen is removed after the capped end of conductor pipe segment 61 has been blasted open by closing down the stop valve 71 and unscrewing the coupler segments 73. In its place a sand screen also indicated at 74 is inserted for use in screening sand out of any oil and gas production flow through the well during operation.

Below the sand screen 74 is a unit 75 which may constitute a coupling for coupling to the production conductor pipe segment 70 an input branch pipeline 77 for supplying to the production conductor pipe 70 and 61 input secondary treatment agents such as high pressure steam, pressurized gas, water, or other suitable treatment agents for increasing flow and production through either the well in question or for increasing production at adjacent well sites in the field. A suitable pressure guage 76 is attached at the input coupling 75 in order to assure that the input secondary treatment pressure is within prescribed values. If desired, additional metering instruments for temperature, flow rate, etc., in monitoring the input of the secondary treatment agents can be installed at this point or the sensors for such parameters can be installed here for leading back to a central control room whereby a master controller can be employed to control these parameters for all the well sites where it is desired to introduce such secondary treatment agents. During normal production from the oil well site, however, the coupling 75 would constitute a straight-through coupling for oil so that it passes down through the lower end of the pipe segment 70 through a second stop valve 78 and any other desired measuring instrument sensor heads indicated generally at 79 for sensing such parameters as the oil and gas pressure, temperature, flow rate, viscosity, or other desired characteristics to be employed in controlling production from the well site. Finally, the conductor pipe segment 70 is coupled to and supplies the collector trunk pipeline 24 for leading the produced oil or gas back out through the tunnel system to the pump 25 at the base of the access shaft 11 for pumping back up to the surface as shown in FIGS. 2 and 2A of the drawings.

With the conductor pipe segment 61 cemented in place and capped at the top, there is no leakage of fluids through the conductor pipe segment 61 until its upper capped end is blasted open. After the conductor pipe segment 70 is in place together with its appended upper stop valve 71, the detonator blast control unit 72, screen 74, coupler 75, the lower stop and flow control valve 78 and appended instrument sensors 79, the lower stop valve 78 is closed and coupler 75 placed in the position such that the supply input branch line 77 is closed and upper stop valve 71 is maintained open. The detonator wires 64 are then connected to a suitable detonating signal generator for detonating the small explosive charge 63 attached to the capped upper end of the cemented conductor pipe segment 61 as shown in FIG. 6. Upon detonating this charge, the wires 64, venting tube 65 together with other assorted rubble will fall down through the conductor pipe segment and be retained by screen 74. The stop valve 71 then is immediately closed to minimize any flow of gas or oil or other fluids through the conductor pipe and allows the lower portion of pipe segment 70 to be opened up, the screen 74 removed together with the collected rubble and a sand screen inserted in its place and the blasting control assembly 72 removed entirely.

While a wired system for detonating the charge 63 and upper capped end of the conductor pipe 61 has been indicated, it should be appreciated by one of ordinary skill in the art that a radio controlled detonator could be employed in place of the wired detonator described with relation to FIG. 6. With such an arrangement, the control assembly 72 would comprise an input transmitter end for a microwave signal generator for emitting a microwave signal up through the cemented conductor pipe 61 which would serve as a suitable waveguide to transmit the control microwave signal to the radio wave controlled detonator thereby eliminating the wires 64 from the rubble that will be collected by the screen 74. Collector screen 74 still would be required however for any rubble that might initially drop down through conductor pipe 61 after blasting open the upper capped end of the pipe. A similar radio wave control venting valve could be installed at the capped end of conductor pipe 61 whereby the valve could be opened during cementing and eliminate the need for the fluid impervious venting pipeline 65 together with its exhaust system, but in such eventuality, the end of the production conductor pipe 61 during cementing would have to be connected to a suitable exhaust conduit temporarily provided during the cementing process for exhausting out any vented gas from the mine workings atmosphere. Further, in place of a combined flow control and stop valve 78, it may be desireable to use single valves for each of these purposes wherein in place of a combined valve there would be a separate lower stop valve such as shown at 78 and below that a flow control valve which could be either manually or automatically controlled from a remote located control room. The operating parameter sensor units 79 would then of course have suitable leads out to the master control room to allow an operator of the well to monitor oil and gas flow out of each well site from the master control room location. Such remotely controlled instrumentation and flow control valves as well as the stop and flow control valves including the upper master stop valve 71 could be designed for remote operation and tied in with a suitable computer system to allow computer control of the oil and gas production from all of the well sites as will be described hereinafter with relation to FIG. 10. Other variations and changes will occur to those skilled in the art of oil well production control for use in place of or in conjunction with the instrumentation and control valve system described above without departing from the spirit of the invention.

In addition to the above-described characteristics, the flow coupler/diverter 75 similarly could be designed to be automatically operated from a remote master control location together with the lower stop valve 78 whereby the production conductor pipe segment 61 of any individual well could be isolated and that well site coupled through the branch pipeline 77 to a supply line 28 for secondary treatment agents extending through the network of horizontal tunnels 16 as shown in FIG. 8A of the drawings. In this manner any individual well site can be either manually or automatically controlled from a remote master control location to convert from a producing well to a well which can be used for injecting secondary treatment agents into the oil bearing sand strata 14 or into an upper gas cap region 17 or a water containing region, etc. as will be described with relation to FIG. 14.

Should alternate systems and techniques for opening the capped end of the production conductor pipe 61 to production be desired, FIG. 8B of the drawings illustrates one possible alternate system. In the arrangement of FIG. 8B, a Johnson type screen is shown at 81 secured to the upper top end of the oil conductor pipe segment 61. Below the Johnson type screen 81 is inserted a suitable flap valve 82 which will prevent any back pressurizing of the conductor pipe 61 until it is desired to place the oil well into production. Here again, a small explosive charge will have to be provided to remove the flap valve 82 together with its remotely actuated detonator charge. Similarly, a small vent opening should be provided through the inclusion of a fluid impervious vent tube together with associated stop valve as described with relation to FIG. 6 to facilitate cementing. The detonator for detonating the flap valve 82 and its attendant connected wires and vent tube may be either a wired detonator or radio wave controlled detonator as described above. If the cost is not prohibitive, the flap valve 82 could be designed to permit a slide opening for a sufficient distance to allow venting of the space to be cemented, during the cementing process, to the interior of the production conductor pipe 61. In this eventuality, some suitable conduit system for exhausting the conductor pipe must be provided to prevent any vent gases from escaping into the mine workings atmosphere. In other respects, the installation and procedure for placing the gravity-type oil drain well into production would be entirely similar to that described earlier with respect to FIGS. 6 and 7. Particular care should be taken, however, during the cementing process to assure that cement does not rise to and clog the openings of the Johnson type screen 81.

An alternative arrangement using a Schlumberger type perforating gun to perforate the upper capped opening of the oil production conductor pipe 61 is illustrated in FIG. 9 of the drawings. The Schlumberger type perforating guns are shown at 85.

In utilizing this system a closed conductor pipe, as indicated in FIG. 6 would be cemented into the drill hole. The explosive charge 63 and detonation wires 64 would not be needed nor would the blasting control assembly, item 72 of FIGS. 7 and 8B.

After the conductor pipe 61 is cemented in place and the collar end finished to its final form, the stop valve 71 can be attached and the fluid and control assembly 40 can be reattached. The conventional Schlumberger perforation gun could then be modified into segments to permit raising through this unit. The Schlumberger unit would have to be redesigned so that the firing circuitry could be plugged through successive pipe segments that would be needed to raise the perforation gun into firing position.

After the conductor pipe had been perforated as desired, the gun could then be lowered through stop valve 71. Then the fluid control assembly 40 could be removed. The blow-out preventors 43 and 44 would prevent fluid and gas leakage into the atmosphere during perforating gun withdrawal. Any fluids produced at this stage would be drained off through valves 45 and 47 as indicated in FIG. 6.

The drainage type oil wells drilled in the abovedescribed manner may be drilled at whatever angle or direction is deemed most feasible for maximization of oil production from a given oil field. The mine workings for access should be designed for each individual oil field but should provide adequate room for collector piping systems, secondary treatment agent piping systems, automated well control systems, ventilation, drainage of the mine workings, and easy access to all well sites for routine inspection and maintenance. During drilling special measures to supply ventilation air and to withdraw any leakage gases around the drilling site by a suitable air and gas exhaust system should be undertaken. Ths may include jacketing and exhausting the drilling rig. Each oil well site should have its own flow meter to measure production of gas, oil and water, pressure gauge, temperature gauge and any other oil well operating characteristic measurement device needed to provide the required measurement to report continuously to a central control station conditions at each well site within the field being mined. As noted earlier, all well sites can be constructed for either automatic or manual changes in well management or production, or both, depending upon the economics of any given oil field being mined.

In addition to the oil well site reporting, production control and management systems described above, the mine workings should be provided with suitable hydrocarbon gas, sulphur gas, carbon dioxide gas, oxygen deficiency and other similar detectors for safety purposes. Further, fire warning systems should be placed at key positions throughout the mine workings with continuous reporting to the central control station. Builtin immediate warning systems should be provided throughout the mine workings to signal personnel should any of the above-noted factors become abnormal and signal the exixtence of problems or the possibility of such problems developing. These warning systems should be designed to warn all persons within the mine workings and alert crews both in the mine workings and on the surface as to the potential for a problem developing.

If the mine workings are monitored in the abovedescribed manner, there should be no fire or explosion hazard provided timely action is taken with respect to any of the advance warning systems output alarms. However, to guard against the unexpected, it is recommended that the mine workings include pipelines carrying carbon dioxide gas, together with valves that can be opened either manually or by remote control. These valves should be so located that any portion of the mine workings can be quickly flooded with carbon dioxide gas thus denying any fire or potential explosion the required oxygen and reducing the potential for a disaster. The same system should be designed to stop normal mine ventilation to an affected area within the mine workings but of course should be tied in with very stringent alarm systems to indicate to personnel within any particular section of the mine that it is about to be $CO_2$ flooded and a safety stop accessible to possible personnel in the affected sector who could countermand the proposed action immediately until excape from the affected section is accomplished.

MINE WORKINGS SUPERVISORY CONTROL SYSTEM

Figures 10, 11:
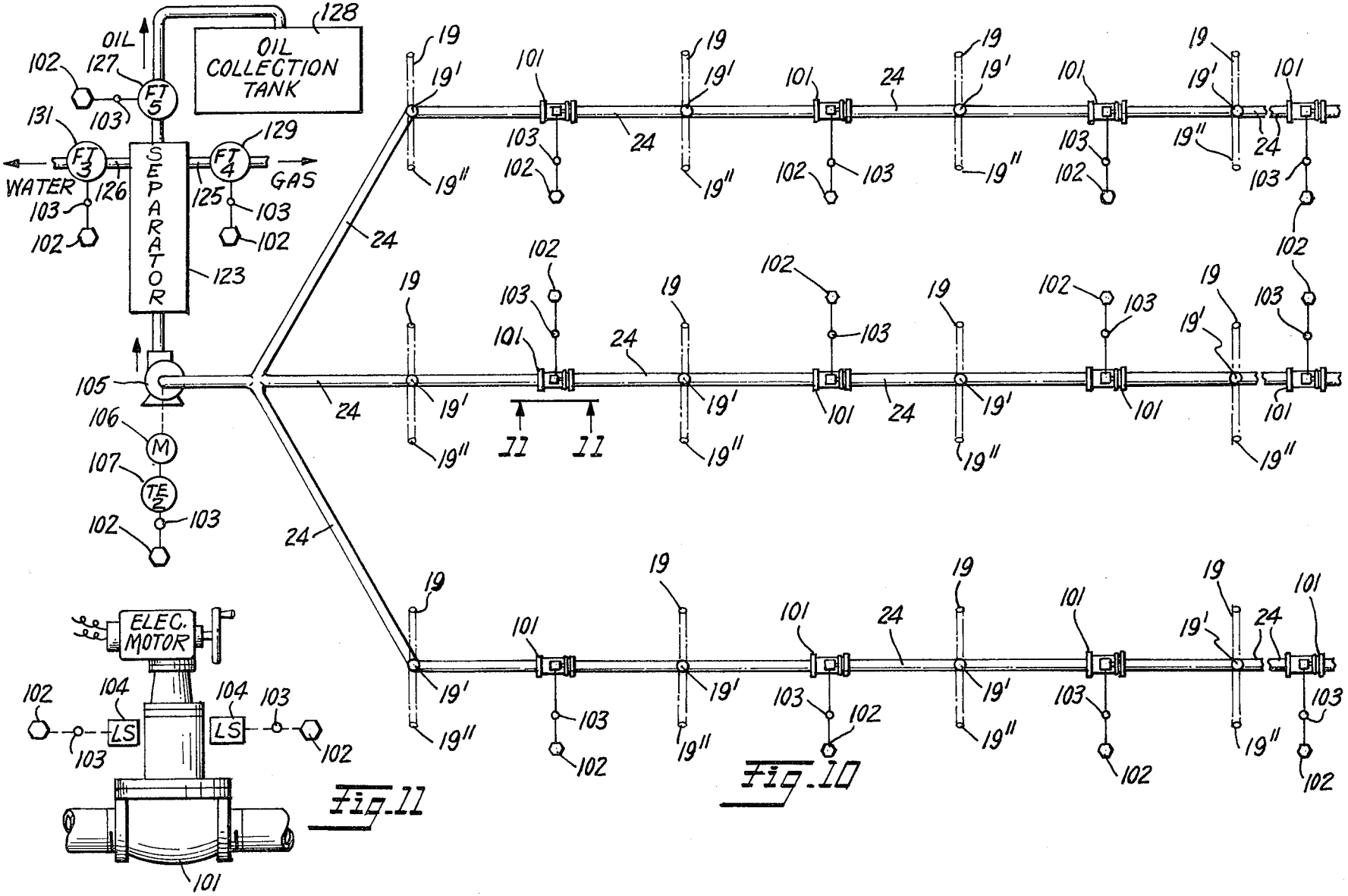
FIG. 10 is a schematic functional diagram of a suitable production fluids sensing and control system useable in conjunction with a main control computer located remotely from the mine workings and which allows oil production within the mine workings to be completely automated, semi-automated or manually controlled as operating conditions permit.
FIG. 11 is a schematic side view of a motor actuated valve used in the control system of FIG. 10 and showing the manner in which limit switches can be employed to telegraph to a main control computer or control console the operating condition of such valves.
Figure 12:
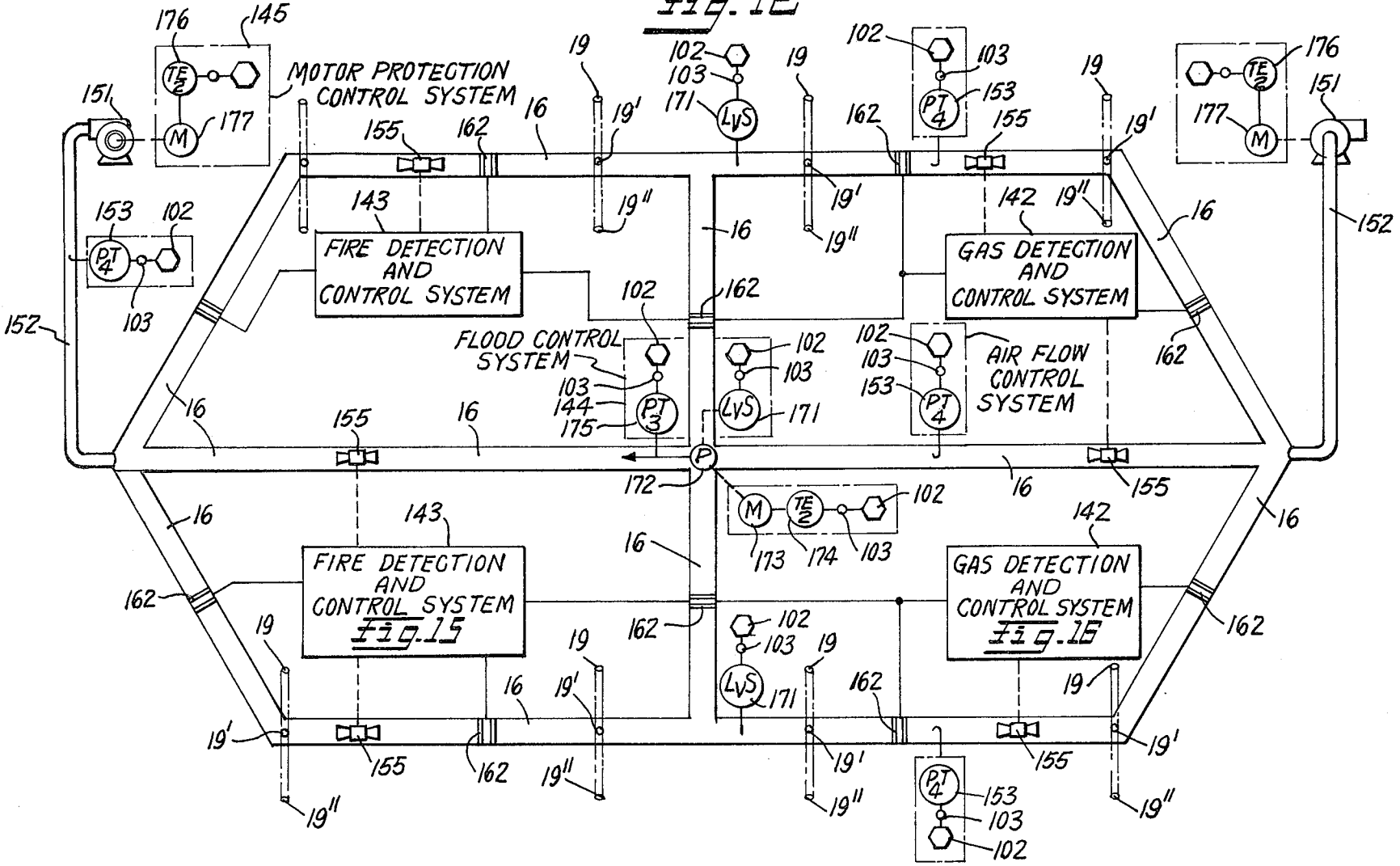
FIG. 12 is a schematic functional diagram of a life support and safety system designed for use in petroleum mines according to the invention and which provide ventilation air, gas detection and protection, fire detection and protection, flooding detection and protection and monitors operation of vital equipment needed in the safe operation of an underground petroleum mine.

FIGS. 10 and 12 of the drawings comprise schematic, functional illustrations of a suitable supervisory control system for the mine workings which embodies the above-listed desirable characteristics and which when used in conjunction with the sensing instruments, pumps, air blowers, motor driven valves, motor driven airtight sealing doors and other devices illustrated schematically in FIGS. 11 and 13-16 together with a main control computer (not shown), provide for safe and productive operation of the petroleum mine from a central control room by supervisory personnel. The control room can be located remotely from the mine workings and above surface so that during continuous operation of the mine only minimum exposure of personnel to hazards inherent in the operation of such a mine will occur. A suitable main control computer for use in such supervisory control system is the Hewlett Packard 2250 Data Acquisition and Control System-Processor and Series Control Computer 9800. While the main control computer itself has not been illustrated, input and output terminals to and from the computer have been shown in the control system schematic diagrams by hexagon-shaped terminals ⬡.

FIG. 10 is a schematic illustration of the mine workings drainage oil collection piping system constructed according to the invention, taken in plan looking down on a typical mine workings without illustrating the interconnecting access tunnels or access shafts, for simplicity in illustration. The various drainage-type oil well sites are shown at 19, 19' and 19" and would correspond to similarly numbered elements described earlier in the specification. The drainage-type oil well sites are interconnected through a mine workings collection piping system shown at 24. Included in the piping system 24 intermediate each interconnected group of drainage-type oil well sites 19, 19', 19" are system flow control valves 101, the construction of which is shown in FIG. 11 of the drawings. The main control computer, the access terminals of which are indicated by the hexagon-shaped terminal 102 is connected to each of the flow control valves 101 through a remote monitoring and signal transmission system 103 such as the Cutler Hammer "DIRECTROL" manufactured and sold by the Cutler Hammer Corporation. As shown in FIG. 11, the flow control valves 101 includes suitable sensors such as limit switches 104 for sensing the condition of the flow control valve 101 whether it is open or closed and if open the degree to which it is open and sending a signal back to the main control computer which is indicative of the operating condition of the flow control valve. By suitably monitoring with a control console the condition of these flow control valves, the mine workings supervisor can control total flow of collected fluids out of the mine workings which then are supplied through suitable booster pumps such as the one indicated at 105 for pumping the collected fluids to the surface for treatment and disposition as will be described further on. As is true in all vital equipment used in the mine workings, the booster pump 105 is driven by a hermetically sealed electric motor 106 whose operating condition is monitored by a temperature sensor TE2-107 whose output is supplied back through the remote monitoring and signal transmission system 103 to the main control computer through terminals 102.

Figure 13:
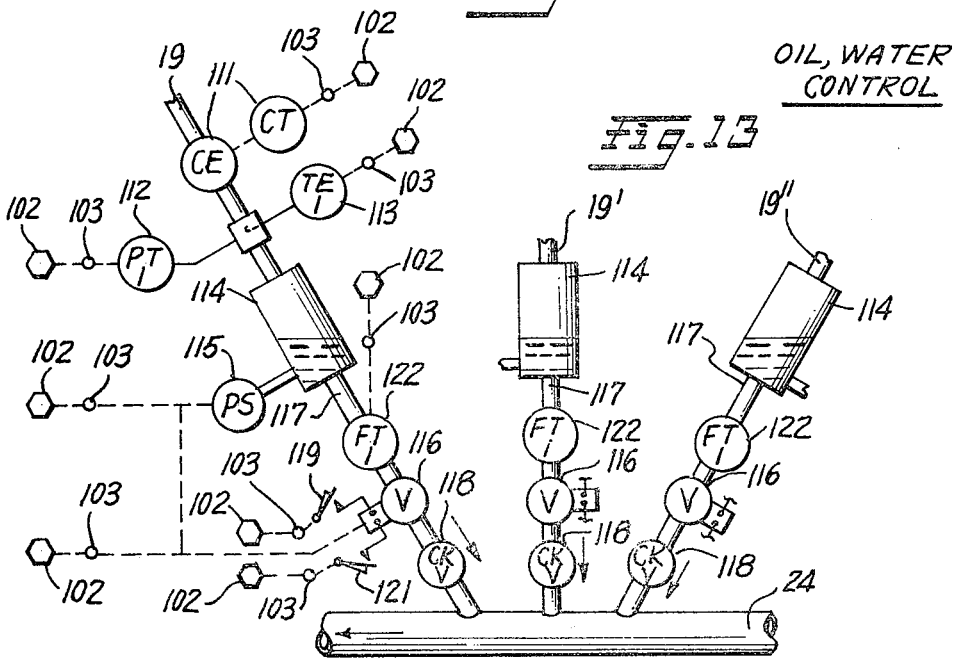
FIG. 13 is a detailed, schematic side sectional view of sub-groups of underground drainage-type mine oil wells constructed according to the invention and filled with necessary sensors and equipment to allow completely automated control over oil production from the wells pursuant to the control system shown in FIG. 10.

FIG. 13 of the drawings is a schematic illustration of a preferred form of drainage well site monitoring and production control system according to the invention for a sub-group of three wells 19, 19' and 19" wherein each well in the sub-group as well as all sub-groups in the collection system are constructed in substantially the same manner, except as to possible modification to include the introduction of secondary treatment agents as will be described with relation to FIG. 14 of the drawings. It is anticipated that the drainage well operation monitoring and control system shown in FIG. 13 would be installed in back of the main, manually and/or automatically operated cutoff valve installed during drilling of the well such as valve 71 shown in FIGS. 7 and 8B of the drawings but would replace other flow control valves, etc., shown in those figures.

As shown in FIG. 13, the output from each individual drainage-type well site 19 is supplied first through a conductivity analyzer device CE-CT-111 such as the Beckman Model CELR 155-160 manufactured and sold by the Beckman Instrument Company. The conductivity analyzer device senses and analyzes the type of fluid being produced by the individual well in question, whether oil, gas or water and transmits a corresponding electrical signal thru the remote monitoring and signal transmission system 103 and computer terminal input 102 to the main control computer indicative of the nature of the fluid being produced by that well site at any given instance. The pressure of the fluid in the well site at the corresponding point in time is sensed by a pressure sensor such as a VITRAN Model 701 pressure sensor 112 which supplies an electrical signal back thru the data transmission system 103 and computer terminal 102 to the main control computer which is indicative of the pressure in the fluid at the well head at any given time. Similarly, a temperture sensor TE1-113 which may be of the type manufactured and sold by H-Cal Engineering their Model ULTRA-7, senses the temperature of the fluids in the well head and supplies an electrical signal through the data transmission system 103 and main computer input terminal 102 back to the main control computer which is indicative of the temperature of the fluids being delivered at the well head. These parameters, i.e. type of fluid, pressure of fluid, and temperature of fluid may be displayed on a suitable display console upon call-up or during periodic checks by the supervisor in charge of the mine.

Control of the fluids discharged from each drainage-type oil well drill hole 19 in the system is accomplished by supplying the discharge after passing sensors 111, 112, and 113 into a holding tank 114 which has a pressure sensor connected thereto for sensing the build-up of pressure in the holding tank 114. Pressure sensor 115 has its electrical output supplied to control operations of a motor operated valve 116 connected in the discharge line 117 from holding tank 114 into the mine workings drainage oil well collection piping system 24 through a conventional check valve 118. Check valve 118 prevents any backup of fluids from the collection system piping 24 in the event the pressure in piping 24 exceeds the pressure in any of the holding tanks 114. The motor operated valve 116 includes operating condition sensor switches 119 and 121 which sense the operating condition of the motor-operated valve 116 whether open or closed and if open to what extent the valve is open and supplies signals back through the data transmission system 103 and terminals 102 to the main control computer for use in monitoring conditions at the well site.

The flow rate of fluids supplied from each well site via holding tank 114 to collection piping system 24 is measured by a flow rate sensor FT1-122 whose output signal is supplied through the data transmission system 103 and terminals 102 back to the main control computer. Based on data supplied from the flow rate sensor 122, the main control computer can compute the true flow rate for given periods of time which together with the identity of the flowing fluid medium as determined by the inputs from a conductivity analyzer 111, provides the mine supervisor with information concerning the totalized flow of fluid through the well head as well as the nature and type of the fluid. The computer of course can integrate the flow rate being sensed by flow rate sensor 122 over particular operating intervals to provide the supervisor with an indication of the total amount and type of fluid being produced over a given period of time.

As noted earlier, control of the discharge of fluids from each oil well site drill hole is accomplished by sensing the hydrostatic head of fluid pressure builtup in the holding tanks 114. When the level of the fluid pressure in holding tank 114 reaches a value indicating a full condition, pressure switch 115 causes motor-operated valve 116 to open thereby emptying the holding tank content into the collection piping system 24. When the pressure sensor switch 115 senses that the tank 114 is substantially empty, the valve 116 is reclosed. The limit switches 119 and 121 on motor-operated valve 116 provide electrical signals to the main control computer which are indicative of the operating condition of the motor-operated valve 116. The piping system motor-operated valves 101 shown in FIG. 10 of the drawings which are located throughout the collection piping system 24 are set to automatically close when flow in excess of a predesigned maximum flow rate occurs, or in the event of a reverse flow. Closure of the valves 101 under such operating conditions, isolates any particular section of the collection piping system 24 that may have ruptured and thus prevents or at least limits spillage that might occur as a result of such rupture. Suitable limit switches on the valves 101 supply information back to the data transmittion system 103 and terminals 102 to the main control computer indicating the operating condition of each of the flow control valves 101 including the information that the valve is open and operating normally.

As described previously, oil bearing fluids collected at each of the drainage-type well sites in the above-briefly described manner is supplied through the mine workings collection system 24 via booster pumps such as 105 shown in FIG. 10 which are located throughout the collection piping system 24 at strategic points. The fluids are pumped to a suitable collection point (which may be above ground) for treatment and storage. At this point, the fluids are supplied to a separator 123 which may be of the type manufactured and sold by CE-NATCO under model VFH. CE-NATCO is the name of the company formed by the merger of Combusion Engineering with National Tank Co.

The separator 123 separates the fluids into their constitutent parts oil, gas and water and supplies each constitutent part through a respective discharge line 124 for the oil, 125 for the gas and 126 for the water. The oil flow rate supplied thru oil line 124 to an oil collection tank 128 is measured by a flow sensor 127 which supplies its output signal back through the transmission line 103 to the main control computer via input terminal 102. The gas being produced by the system is measured by a flow sensor 129 installed in the gas outlet line 125 which supplies its output signal back through the transmission line 103 and terminal 102 to the main control computer. Similarly, water being produced by the system and supplied through outlet line 126 is measured by a flow sensor 131 whose sensed signal is supplied back to the main control computer via transmission line 103 and terminal 102. At this point in the system operation, the computer is provided with sufficient input data to provide a cross check on the summation of the flow rate produced at each of the drainagetype oil well sites against the summation of the production flow rates of the respective constitutent fluids oil, gas and water. Oil from the separator is supplied to the collection tank 128 which normally will be located above the surface. The gas being produced by the mine can flow either to gas pipe lines for supply to a market, to a storage tank or can be used to repressure the oil field being drained by the mine. Water being produced by the system either can be discharged to waste or can be pumped back to maintain pressure on the oil field being drained.

Figure 14:
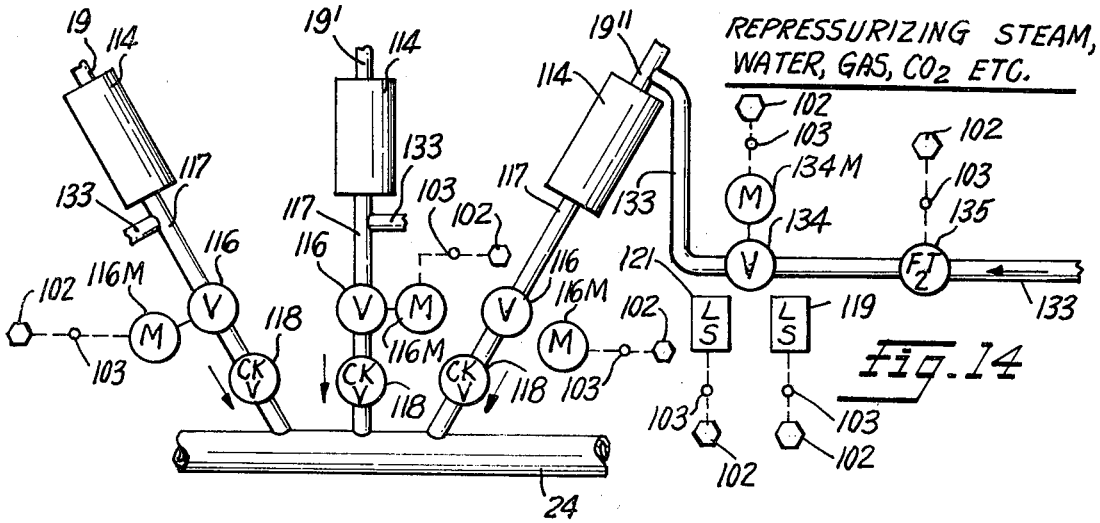
FIG. 14 is a detailed, schematic side sectional view of an alternative form of installation similar to that of FIG. 13 but which allows introduction in a controlled manner of secondary treatment agents into selected ones of the drainage-type underground mine oil wells for use in conducting re-pressurization and/or other secondary treatment processes in connection with selected portions of the oil field.

FIG. 14 is a schematic illustration of an alternative production control installation for use at the respective drainage-type oil well sites 19, 19' and 19''. For the sake of simplicity, the illustration shown in FIG. 14 does not include the conductivity analyzer 111, the pressure sensor 112, the temperature sensor 113 or the main flow sensor 122 in order not to unduly complicate the drawings. However, it is anticipated that all of these sensing instruments would be included in the alternative embodiment shown in FIG. 14 but have not been illustrated in order not to unduly complicate the drawings. The significant elements such as the holding tank 114 and the main flow control valves 116 have been illustrated however in order to show the alternative system connection points.

The alternative installation shown in FIG. 14 is intended for use with those mine fields where it is anticipated that secondary treatment processes will have to be applied in order to maximize oil production from the petroleum mine. Secondary treatment processes and agents used in such processes are well known in conventional oil well production systems, and hence need not be described in detail. In such secondary treatment processes, a secondary treatment agent such as steam, water, pressurized gas, or other similar agent is introduced into the oil bearing sand strata, or the gas cap above the oil bearing sand strata or the water table below the oil bearing sand strata. In order to introduce such secondary treatment agents, a separate line working secondary treatment supply piping system (not shown in overall systems context) indicated in part at 133 in FIG. 14 is connected to the discharge conduit 117 interconnecting the holding tank 114 with the main mine workings drainage oil collection piping system 24. In this alternative installation, the valve 116 will have to be a separate motor-operated valve under the control of the main control computer via terminal 102 and data transmission system 103 whereby the valve 116 selectively can be closed in order to introduce secondary treatment agents into the well head at any one of the drainage-type oil well sites 19. Prior to the introduction of any such secondary treatment agents, the main drainage valves 116 are closed by their associated motor 116M via the main control computer.

The secondary treatment agents are introduced via the piping system 133 by means of an on-off control valve 134 whose on-off condition is indicated back at the main control computer console via the limit switches 119 and 121 and which can be opened or closed from the main control computer console by motor 134M via the main control computer terminal 102 and data transmission system 103. A flow sensor 135 connected in a secondary treatment agent supply pipeline 133 measures the flow of the secondary treatment agents passing through the pipeline and supplies the flow rate back to the main control computer via data transmission 103 and terminal 102.

With a well head installation constructed as shown in FIG. 14, the flow of secondary treatment agents such as steam, water, gas, surfactants or other secondary recovery enhancing agents is measured by the flow rate sensor 135 appropriate for the secondary treatment medium being used. The resulting electrical signal is transmitted back to the main control computer console for display and recording and use by supervisory personnel in working the main field. Pressurization of the mine field secondary treatment agents is accomplished from the main control console first by operating the motor 116M to close the main drainage control valve 116 and thereafter operating the motor 134M to open or close the secondary treatment agent flow control valve 134. The limit switches 119 and 121 provide positive feedback signals to the main computer control console for displaying the operating condition of the secondary treatment agent flow control valve 134. The flow rate sensor 135 keeps supervisory personnel advised of the rate of introduction of the secondary treatment agent and the computer can integrate the flow rate over predetermined periods of time to display and record the total amount of secondary treatment agent being introduced for the period in question. It is anticipated that not all of the well sites in any sub-group or other groupings of well sites would be pressurized with secondary treatment agents at the same time, but that such secondary treatment processes would be used to enhance oil recovery at other adjacent sites in a predetermined pattern of pressurization and secondary treatment. Consequently, at the producing oil well sites, the pressure at the well head, the temperature of the well head and the classification of the fluids being produced will be recorded by that particular well site's sensing instrumentation and fed back to the main control computer for recording, display and use by supervisory personnel in enhancing oil recovery from the petroleum mine. If desired, the same supply system can be employed to depressurize a particular oil well site by bleeding off gases, water and the like to a collection point above ground to the desired extent to return a particular site to gravity-drain type of operation as opposed to a pressurization-squeeze type of operation again under the control of the main computer and supervisory personnel at the main computer control console.

In addition to the above-described forms of secondary treatment, there are other known secondary treatment procedures which have been successfully used to enhance oil well production and which utilize electromagnetic radiation in the form of either radio frequency wave or microwave propogation of electromagnetic waves through the oil bearing sands. This is achieved with suitable electrode emplacement and excitation by a radio wave frequency or microwave frequency signal source for propogating such electromagnetic waves through the oil bearing sands. The present invention contemplates the use of such electromagnetic waves secondary treatment procedures by suitable emplacement of the required electrodes and radio frequency signal transmitters at strategic points in the access tunnels as well as in the access vertical shafts to enhance collection at the drainage-type oil well sites. It is anticipated that in any such system, control over the electromagnetic wave signal producing equipment would be achieved via the main control computer by the mine workings supervisory personnel.

FIG. 12 is a schematic diagram of the air supply and personnel protection detection and control systems required for safe operation of the mine workings. These protective systems include an air flow monitoring and control system shown generally at 141, a gas detection and control system shown generally at 142, a fire detection and protection control system shown generally at 143, a mine flooding detection and protection control system shown generally at 144, and a vital motor protection control system shown generally at 145. All of these detection and protection control systems have elements located at strategic points throughout the mine workings, the network of which is shown at 16 and are comprised generally by the access tunnels 16 which extend through the lower competent rock level below the oil field being mined. As will become apparent, all of the personnel protective systems listed above and to be described in detail hereafter, provide sensory inputs to the main control computer via data transmission links and the input terminals so that supervisory mine personnel operating from the computer control console can continuously monitor safety conditions within the mine workings and undertake protective measures whenever such measures are indicated.

AIR FLOW AND MONITORING CONTROL SYSTEM

Adequate fresh air supply for personnel in the mine working is assured by a number of air blowers shown at 151 which are located at strategic points throughout the mine workings for supplying forced air through ducting indicated at 152 having suitable air discharge outlets at preselected points throughout the mine working access tunnel 16 network. At selected points throughout this air supply ducting system air flow sensors PT4-153 are installed for measuring the flow rate of air at these points in the air supply ducting system. The air flow rate sensors 153 have their outputs supplied back through the data transmission system 103 and input terminals 102 to the main control computer for display and recording and use by supervisory personnel in maintaining safe conditions in the mine. In the event that air supply to any particular section of the mine is interrupted, the main control computer automatically or under the control of the supervisory personell can signal both a visual and audible alarm indicated at 155 located throughout the mine workings in order to alert personnel in the mine of the danger.

GAS DETECTION AND PROTECTION SYSTEM

Figure 16:
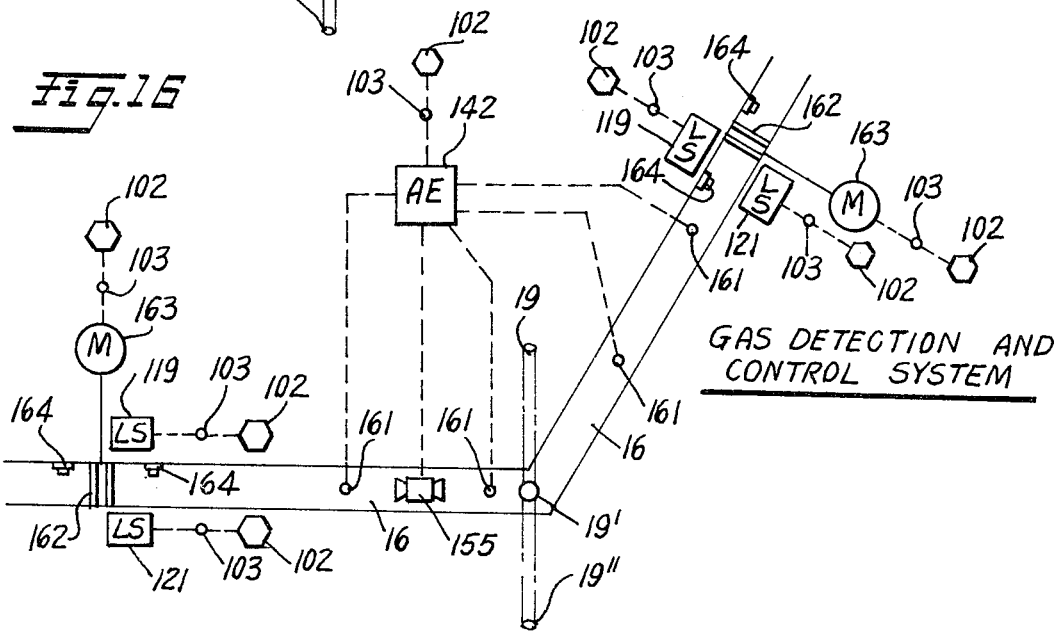
FIG. 16 is a partial, detailed, schematic diagram showing the Gas Detection and Control System comprising a part of the overall life support system of FIG. 12.

The gas detection and control system 142 may comprise a system such as the mine safety appliance series 500 system shown generally at 142 in FIG. 16. This system includes a number of methane gas sensors indicated at 161 for sensing the build-up of methane or other dangerous gases within the mine workings access tunnels or vertical shafts and providing an output signal of the build-up of such dangerous gases back to the main control computer via the data transmission system 103 and terminals 102. The gas protection system further includes a series of gas-tight doors shown at 162 in both FIGS. 12 and 16 of the drawings which can be opened and closed by motors 163 under the control of the main control computer via terminals 102 and data transmission system 103. Limit switches 119 and 121 sense whether the door is opened or closed and provide output signals back to the main control computer via the data transmission system 103 and terminals 102 as a backup indication to supervisory personnel of either the opened or closed condition of the doors 162. Manually operated electric switches shown at 164 are installed on each side of every door 162 so that personnel caught in a section which is being closed off can open the door for egress. When a door is thus opened, the main control computer automatically recloses it after a predetermined time interval should conditions not permit the personnel seeking to escape from a section enough time to reclose the door after opening it.

A further function of the gas detection and protection system 142 shown in FIGS. 12 and 16 is to immediately sound a local alarm shown at 155 which is located at regular intervals along each section of the mine workings. The local alarm 155 provides both a visual and sound warning signal to personnel who may be located in an affected section. It is anticipated that in a petroleum mine, all personnel will be rigorously trained in safety procedures. These safety procedures will include the required carrying of oxygen masks which can be donned by all personnel entering the mine immediately upon the occurrance of an alarm signal by the alarms 155 in a section where they may be working. The personnel thus assured of an adequate oxygen supply then can work themselves out of an isolated section of the mine in the event that the condition requires immediate closing and sealing off by the airtight doors 162 and $CO_2$ flooding of an endangered section of the mine workings.

FIRE DETECTION AND PROTECTION SYSTEM

Figure 15:
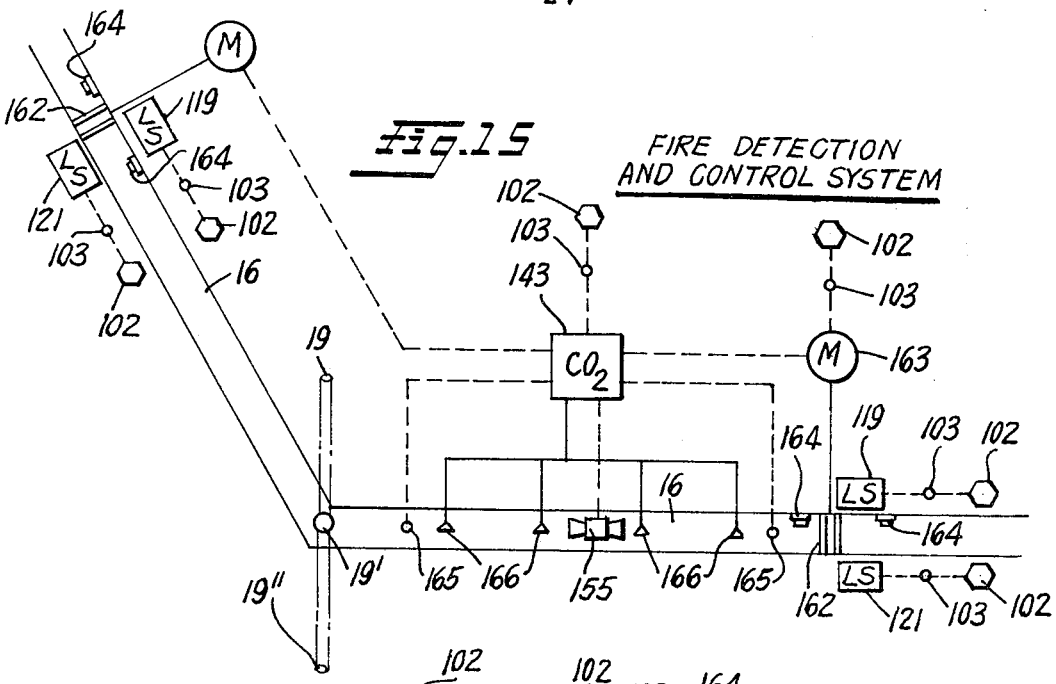
FIG. 15 is a partial, detailed, schematic diagram showing the Fire Detection and Protection System portion of the life support system shown generally in FIG. 12.

The fire detection and protection system 143 is shown in greater detail in FIG. 15 of the drawings. The system is comprised by a plurality of smoke/temperature sensors shown generally at 164 in FIG. 15 which supply alarm signals to a central control panel 143 commected through data transmission system 103 and terminal 102 back to the main control computer. The first protection and detection system 143 can be installed so as to automatically activate the cardox-type carbon dioxide fire extinguishing system shown generally at 165 for immediate $CO_2$ flooding of any first that might occur in a given section of the mine workings. Simultaneously, the occurrance of an alarm condition and presence of the fire is signalled back through the main control computer for use by supervisory personnel in ascertaining what other further protective measures might be taken. Concurrently with the activation of the carbon dioxide ($CO_2$) extinguishing system, fire protection system 143 is connected to activate the drive motors 163 for automatically closing the air and gas-tight doors 162 for isolating particular sections of the mine workings as described above with respect to the gas detection and protection control system. The limit switches 119 and 121 monitor the condition of the doors 162 and signal back to the main control computer whether the door is open or closed. Here again, the presence of manually actuated switches 164 on either side of the sealing doors 162 can be manually actuated by any personnel present in the affected section to allow egress of such personnel. The fire protection system 143 also instantaneously sounds the local alarm 155 to advise mine personnel of the onset of a danger should they be in a section of the mine workings affected by the detected fire. A further protective step which can be taken by the supervisory personnel at the control console of the main control computer, is to discontinue the supply of ventilating air to an affected section after detection of the onset of a fire alarm condition. This can be safely done since any affected personnel will be carrying oxygen masks which they will have donned.

MINE FLOODING PROTECTION AND DETECTION SYSTEM

In the event of flooding of any part of the mine workings by water or other liquid, level sensing switches shown at 171 in FIG. 12 and comprising part of the flood detection and control system 144, will sense the build-up of water and signal the occurance of a flooding condition to the main control via data transmission system 103 and computer input/output terminal 102. The level sensing switches 171 will be distributed throughout the floor of the mine working for sensing the occurrance of flooding in any section of the mine. Level sensing switch 171 also is connected to acutate the nearest sump pump shown at 172 whose motor 173 is monitored by a temperature sensor 174 supplying its output signal through data transmission link 103 and terminal 102 back to the main control computer which can monitor then safe operation of the sump pumps. As an additional piece of data, a pressure sensor indicated at 175 monitors the discharge pressure of the sump pump 172 and supplies its output signal back through data link 103 and terminal 102 to the main control computer. Thus, the level sensing switches 171 can sense the build-up of water or oil on the mine floor and signal this condition back to the main control computer. Simultaneously, the affected sump pumps 172 will be actuated to pump out the liquid through an appropriate discharge conduit (not shown) which transports the flood waters to a remote point for discharge safely away from the mine workings. During operation, the sump pumps are monitored by the temperature sensor 174 and pressure output sensor 175 and the outputs of these sensors are supplied back to the main control computer for use by supervisory personnel in monitoring safe operation of the mine flooding protection system thus comprised.

VITAL MOTOR PROTECTION SYSTEM

In addition to the detecting and protecting system described above, all of the vital motors employed in the personnel protective safety systems of the mine such as air blower motors, sump pumps, safety door closure motors, valve motors and the like are monitored by temperature sensors such as 174 for the sump pump motor and temperature sensors such as 176 shown used in conjunction with the drive motors 177 for driving air blowers 151. Similar temperature sensors for the isolation sealing doors 162 drive motors, the valve drive motors and the like have not been shown for the sake of simplicity. The temperature sensors thus comprised all are connected back to the data transmission system link 103 and computer input/output terminal 102 to the main control computer to facilitate monitoring of the safe operation of these vital motors throughtout the mine workings personnel protective systems.

From the foregoing description, it will be appreciated that the status of all operating parameters of the petroleum mine together with the status of the personnel protective systems can be sensed by instrumentation and the outputs are presented to mine supervisory personnel on a cathode ray tube or other display which is a part of the control console of the main control computer. With this data and the in-place sensors, control valves, drive motors and the like the mine supervisory personnel can remotely start or stop all motors, open and close all doors and valves, and activate any alarm systems such as horns, lights, $CO_2$ fire extinguishing systems and the like.

Having described several methods, systems and forms of apparatus to be employed in carrying out the novel method of underground mining of petroleum according to the invention, it is believed that other modifications, changes and variations to the described methods, systems, and apparatus will occur to those skilled in the art in the light of the above teachings. It is therefore to be understood that all such obvious changes to those of ordinary skill in the art are believed to come within the scope of the invention as defined by the appended claims.

What is claimed is:

1. The method of drilling a relatively small diameter gravity-type drain oil well using a fluid and cutting control assembly comprising a stop valve mounted on a pipe casement for securement to a firmly anchored collar pipe providing the outer liner for an access opening to a gravity-type drain oil well, said gate valve and pipe casement having an inside diameter opening with said gate valve in the open condition sufficient to accommodate the outside diameter of gravity-type drain oil well production conductor pipe and drill string-together with appended stop valves, couplings and the like, upper and lower blow-out preventers secured to said casement below said stop valve and having internal diameters sufficient to accommodate the external diameter of the gravity-type drain oil well production conductor pipe and drill string fittings, an upper drain vent control valve connected to a first drain vent branch pipeline and to said casement between the stop valve and the upper blow-out preventer and a lower drain vent control valve connected to a second drain vent branch pipeline and to the casement intermediate the upper and lower blow-out preventers, and wherein the assembly is secured to an annular collar mounted in and surrounding a relatively small diameter access opening for a gravity-type oil drain well to be drilled into the overlying roof of a tunnel cut into a competent rock zone below oil well sands containing unrecovered oil, inserting the drill bit and supporting drill string through the opened lower and upper blow-out preventers and through the opened stop valve, drilling the small diamter gravity-type oil drain well upwardly through the overlying competent rock roof of the tunnel and into the oil bearing sand zone to a desired depth while supplying cutting fluid to the drill bit under pressure upwardly through the drill string, maintaining the upper and lower blow-out preventers tightened down on the exterior of the drill string to only a slide fit during drilling and drawing off used cutting fluid and entrained cuttings through the upper and lower drain vent control valves and connected branch drain pipelines for removal to the surface.

2. The method according to claim 1 further comprising sequentially loosening and tightening the upper and lower blow-out preventers while inserting or withdrawing additional lengths of drill string during the drilling and removal of the drill string.

3. The method according to claim 1 further comprising introducing a solidifying agent into the drilling fluid at the point in drilling operation where the drill bit enters the oil bearing strata to facilitate drilling the gravity drain wells through the oil bearing strata to a desired depth into the underlying competent rock strata.

4. The method according to claim 3 using the fluid and cutting control assembly for installing oil well production conductor pipe in the relatively small diameter gravity-type oil drain well after drilling of the drain-type oil well hole comprising loosening the upper and lower blow-out preventers while withdrawing the drill string to the point where the drill bit is just below the stop valve while drawing off any fluid, cuttings, oil, gas and water through the upper and lower drain vent control valves for removal to the surface, closing the stop valve, inserting the production conductor pipe within the casement through the loosened upper and lower blow-out preventers to a point where the upper end of the conductor pipe is just below the stop valve, tightening the blow-out preventers to the point of providing a slide fit for the exterior surface of the production conductor pipe while maintaining the upper and lower drain vent control valves open to drain off any leakage of fluid past the upper blow-out preventer, opening the stop valve and driving the production conductor pipe upwardly through the drilled opening into the oil bearing sand strata to a desired depth.

5. The method according to claim 1 using the fluid and cutting control assembly for installing oil well production conductor pipe in the relatively small diameter gravity-type oil drain well after drilling of the drain-type oil well hole comprising loosening the upper and lower blow-out preventers while withdrawing the drill string to the point where the drill bit is just below the stop valve while drawing off any fluid, cuttings, oil, gas and water through the upper and lower drain vent control valves for removal to the surface, closing the stop valve and withdrawing the drill bit and drill string from the fluid and cutting control assembly, inserting the production conductor pipe within the casement through the loosened upper and lower blow-out preventers to a point where the upper end of the conductor pipe is just below the stop valve, tightening the blow-out preventers to the point of providing a slide fit for the exterior surface of the production conductor pipe while maintaining the upper and lower drain vent control valves open and under suction to drain off any leakage of fluid past the upper blow-out preventers, opening the stop valve and driving the production conductor pipe upwardly through the drilled opening into the oil bearing sand strata to a desired depth.

6. The method according to claim 5 wherein the upper end of the relatively small diameter gravity-type oil drain well production conductor pipe is closed during the emplacement thereof and means are provided for selectively opening the upper end of the production conductor pipe after it is secured in place to a desired dpeth into the oil sand strata in order to place the well into production.

7. The method according to claim 6 wherein the space between the exterior of the conductor pipe and the sides of drilled oil well hole for accomodating the pipe is vented to facilitate emplacement and subsequent cementing into place of the conductor pipe.

8. The method according to claim 7 wherein the venting of the space intermediate the drilled hole and the conductor pipe is accomplished by a small diameter flexible fluid impervious venting tube extending up through the interior of the pipe and having the upper tip end extending through a small port in the upper end of the conductor pipe and a venting tube control valve secured in the venting tube at a lower accessible end of the vent tube with the vent tube being discharged to an exhaust conduit to the surface.

9. The method according to claim 7 wherein the production conductor pipe is permanently cemented into place by tightening down the upper and lower blow-out preventers to the greatest possible extent to prevent movement to the conductor pipe during cementing, and forcing cement under pressure from a cement pump connected through the upper drain vent control valve and its interconnected first branch pipeline with the stop valve in its fully open condition to completely fill the space of the drilled oil well holes surrounding the conductor pipe with cement down to the top of the upper blow-out preventer while venting said space from the top, removing the fluid and cuttings control assembly including the stop valve after the cement sets, and coupling additional lengths of production conductor pipe to the cemented in place conductor pipe through at least one stop valve.

10. The method according to claim 9 employing a fluid cuttings and control assembly wherein the lower drain vent control valve is above the lower blow-out preventer and closely adjacent thereto and a third drain vent control valve is connected to a third drain vent branch pipe line and to the casement at a point below the upper blow-out preventer and closely adjacent thereto and wherein water is introduced into the casement in the space between the casement and the exterior of the production conductor pipe prior to cementing by supplying water under pressure from a water pump through the lower drain vent control valve and interconnected second drain vent branch pipeline with the third drain vent control valve initially open to vent the space between the upper and lower blow-out preventers while filling the same with water and then closed to fill the space with water under pressure greater than the pressure used in the cementing of the production conductor pipe whereby the fluid cutting and control assembly can be kept clean of cement for repeated use at different oil well sites.

11. The method according to claim 9 wherein the closed upper end of the production conductor pipe has a small charge of explosive attached thereto for blowing open the end of the conductor pipe to place it into production and a small remotely operated detonator is secured to the charge of explosive for selectively detonating the charge to blow open the top of the conductor pipe and place it into production.

12. The method according to claim 9 wherein the closed upper end of the production conductor pipe is closed by a screen having a closure element disposed in the conductor pipe below the screen for preventing flow of fluids through the pipe during its emplacement, a small charge of explosive attached to the closure element and a small remotely operated detonator secured to the charge of explosive for selectively detonating the charge and blowing open the closure element to place the well into production.

13. The method according to claim 9 wherein the closed upper end of the production conductor pipe has a perforating gun secured therein for perforating upper sides and closed upper end of the conductor pipe and remote operated means for selectively firing the Schlumberger typer perforating gun when it is desired to place the gravity drain-type oil well into production.

14. The method of sinking a relatively large diameter vertical shaft for an oil mine capable of accommodating workmen and equipment extending from an upper competent rock zone through an intermediate oil bearing sand zone into a lower competent rock zone forming a laterally extending annular chamber in the upper competent rock zone immediately above the oil bearing sands and surrounding the vertical shaft using known horizontal tunnel rock boring techniques, said annular chamber being of sufficient extent to accommodate workmen and the drilling of a predetermined pattern of small diameter holes into the floor of the annular chamber surrounding the vertical shaft to varying degrees within the oil bearing sand zone, supplying a solidifying agent through the holes into the oil bearing sand immediately surrounding the vertical shaft through substantially the extent of the thickness of the oil sand zone to thereby thicken and substantially solidify, the oil and water bearing sands in the region below the vertical shaft, sinking the vertical shaft further downward through the remaining thickness of the upper competent rock zone, the solidified thickness region of the oil bearing sand zone and into the lower competent rock zone to a desired depth, lining the depth of the vertical shaft with a suitable liner that is impervious to pressurized fluids, and driving one or more horizontal tunnels of sufficient size to accommodate workmen and rock drilling equipment horizontally out from the base of the shaft to a desired extent using known horizontal tunnel rock boring techniques.

15. The method according to claim 14 wherein the solidifying agent is a grout such as cement, silicon flouride and the like.

16. The method according to claim 14 wherein the solidifying agent is a ground freezing agent for lowering the temperature of the oil bearing sands in the region of the vertical shaft to a temperature below the freezing point of water.

17. The method according to claim 14 wherein the horizontal tunnels are formed in a desired pattern extending outward from the vertical shaft to form a predetermined drain basin, the tunnels are bulwarked and shored in accordance with known mining safety techniques and regulations and are properly ventilated to assure safe working spaces for humans.

18. The method according to claim 17 wherein the horizontal tunnels each have a plurality of relative small diameter gravity-type drain wells drilled generally upward through the overlying competent rock layer roofs thereof at predetermined spaced-apart points along the lengths of the tunnels, said gravity-type drain wells extending upwardly through the overlying competent rock layer roof to extend into the overlying oil sand zone to a desired depth.

19. The method according to claim 18 wherein the horizontal tunnels are sufficiently large to accommodate utility pipelines for supply of electricity, ventilating air, compressed air steam, drilling and secondary treatment fluids and the like to gravity drain-type oil well sites along the length of the tunnel as well as return conduits for waste drilling fluids, cuttings, exhaust air, oil and/or gas, water and the like to the base of a vertical shaft for pumping back up to the surface.

20. The method according to claim 19 wherein the relatively small diameter gravity-type drain oil wells each are drilled using a fluid and cutting control assembly comprising a stop valve mounted on a pipe casement for securement to a firmly anchored collar pipe providing the outer liner for an access opening to a gravity-type drain oil well, said gate valve and pipe casement having an inside diameter opening with said gate valve in the open condition sufficient to accomodate the outside diameter of gravity-type drain oil well production conductor pipe and drill string-together with appended stop valves, couplings and the like, upper and lower blow-out preventers secured to said casement below said stop valve and having internal diameters sufficient to accommodate the external diameter of the gravity-type drain oil well production conductor pipe and drill string fittings, an upper drain vent control valve connected to a first drain vent branch pipeline and to said casement between the stop valve and upper blow-out preventer and a lower drain vent control valve connected to a second drain vent branch pipeline and to the casement intermediate the upper and lower blow-out preventers, and wherein the assembly is secured to an annular collar mounted in and surrounding a relatively small diameter access opening for a gravity-type oil drain well to be drilled into the overlying roof of a tunnel cut into a competent rock zone below oil well sands containing unrecovered oil, inserting the drill bit and supporting drill string through the opened lower and upper blow-out preventers and through the opened stop valve, drilling the small diameter gravity-type oil drain well upwardly through the overlying competent rock roof of the tunnel and into the oil bearing sand zone to a desired depth while supplying cutting fluid to the drill bit under pressure upwardly through the drill string, maintaining the upper and lower blow-out preventers tightened down on the exterior of the drill string to only a slide fit during drilling and drawing off used cutting fluid and entrained cuttings through the upper and lower drain vent control valves and connected branch drain pipelines for removal to the surface.

21. The method according to claim 20 further comprising introducing a solidifying agent into the drilling fluid at the point in drilling operation where the drill bit enters the oil bearing strata to facilitate drilling the gravity drain wells through the oil bearing strata to a desired depth into the underlying competent rock strata.

22. The method according to claim 20 using the fluid and cutting control assembly for installing oil well production conductor pipe in the relatively small diameter gravity-type oil drain well after drilling of the drain-type oil well hole comprising loosening the upper and lower blow-out preventers while withdrawing the drill string to the point where the drill bit is just below the stop valve while drawing off any fluid, cuttings, oil, gas and water through the upper and lower drain vent control valves for removal to the surface, closing the stop valve, inserting the production conductor pipe within the casement through the loosened upper and lower blow-out preventers to a point where the upper end of the conductor pipe is just below the stop valve, tightening the blow-out preventers to the point of providing a slide fit for the exterior surface of the production conductor pipe while maintaining the upper and lower drain vent control valves open and under suction to drain off any leakage of fluid past the upper blow-out preventers, opening the stop valve and driving the production conductor pipe upwardly through the drilled opening into the oil bearing sand strata to a desired point.

23. The method according to claim 22 wherein the upper end of the relatively small diameter gravity-type oil drain well production conductor pipe is closed during the emplacement thereof and means are provided for selectively opening the upper end of the production conductor pipe after it is secured in place to a desired depth into the oil sand strata in order to place the well into production.

24. The method according to claim 23 wherein the space between the exterior of the conductor pipe and the sides of drilled oil well hole for accommodating the pipe is vented to facilitate emplacement and subsequent cementing into place of the conductor pipe.

25. The method according to claim 24 wherein the venting of the space between the drilled hole and the conductor pipe is accomplished by a small diameter flexible fluid impervious venting tube extending up through the interior of the pipe and having the upper tip end extending through a small port in the upper end of the conductor pipe and a venting tube control valve secured in the venting tube at a lower accessible end of the vent tube with the vent tube being discharged to an exhaust conduit to the surface.

26. The method according to claim 25 wherein the production conductor pipe is permanently cemented into place by tightening down the upper and lower blowout preventers to the greatest possible extent to prevent movement of the conductor pipe during cementing, and forcing cement under pressure from a cement pump connected through the upper drain vent control valve and its interconnected first branch pipeline with the stop valve in its fully open condition to completely fill the space of the drilled oil well hole surrounding the conductor pipe with cement while venting said space from the top.

27. The method according to claim 26 wherein the closed upper end of the production conductor pipe has a small charge of explosive attached thereto for blowing open the end of the conductor pipe to place it into production and a small remotely operated detonator is secured to the charge of explosive for selectively detonating the charge to blow open the top of the conductor pipe and place it into production.

28. The method according to claim 26 wherein the closed upper end of the production conductor pipe is closed by a screen having a closure element disposed in the conductor pipe below the screen for preventing flow of fluids through the pipe during its emplacement, a small charge of explosive attached to the closure element and a small remotely operated detonator secured to the charge of explosive for selectively detonating the charge and blowing open the closure element to place the well into production.

29. The method according to claim 26 wherein the closed upper end of the production conductor pipe has a perforating gun supported therein for perforating upper sides and closed upper end of the conductor pipe and remote operated means for selectively firing the perforating gun when it is desired to place the gravity drain-type oil well into production.

30. The method according to claim 26, 27, 28 or 29 wherein at least a second parallel vertical shaft is driven through the upper competent rock zone, the oil bearing sand zone and into the lower competent rock zone in a similar manner and a horizontal tunnel joins the base of the two shafts to form an underground central work area whereby one of the vertical shafts can be used for ventilating air supply, utilities, working fluid supply and other services required by the mine and for working personnel access and egress to the work area and tunnels, and the remaining shaft can be used for ventilation exhaust, removal of tunnel and drill hole cuttings, produced gas and oil, removal of mine waste water and provides an escapeway for working personnel should it be required.

31. The method according to either of claims 6, 11, 12, 13, 23, 27, 28 or 29 wherein suitable monitoring instruments in the form of flow rate sensors, temperature sensors, pressure sensors, viscosimeters and the like are mounted on an accessible end of the production conductor pipe at respective ones of the gravity-type drain oil wells to assist in monitoring and controlling production of the well.

32. The method according to either of claims 6, 11, 12, 13, 23, 27, 28 or 29 wherein suitable fittings are secured to an accessible end of the production conductor pipe at respective ones of the gravity-type drain oil wells to allow for back pressuring the respective wells with compressed gas, steam, water and secondary treatment agents to improve production from the wells.

33. The method according to either of claims 6, 11, 12, 13, 23, 27, 28 or 29 wherein radio wave propagating means are mounted in the oil sand strata being drained for producing and propagating electromagnetic waves in either the radio frequency or microwave range through the oil sands to increase the temperature of the oil-bearing zone thus lowering the oil viscosity, and increasing the gas pressure in the reservoir to facilitate drainage of oil through the wells.

34. The method according to either of claims 6, 11, 12, 13, 23, 27, 28 or 29 wherein radio wave propagating means are mounted in the oil sand strata being drained for producing and propagating electromagnetic waves in either the radio frequency or microwave range through oil sands to facilitate drainage of oil through the wells, and wherein suitable monitoring instruments in the form of flow rate sensors, temperature sensors, pressure sensors, viscosimeters and the like are mounted on an accessible end of the production conductor pipe at respective ones of the gravity-type drain oil wells to assist in monitoring and controlling production of the well, and wherein suitable fittings are secured to an accessible end of the production conductor pipe at respective ones of the gravity-type drain oil wells to allow for back pressuring the respective wells with compressed gas, steam, water and secondary treatment agents to improve production from the wells.

35. The method according to claim 14 wherein a second parallel vertical shaft is driven through the upper competent rock zone, the oil bearing zone and into the lower competent rock zone in a similar manner and a horizontal tunnel joins the base of the two shafts to form an underground central work area whereby one of the vertical shafts can be used for ventilating air supply, utilities, working fluid supply and other services required by the mine and for working personnel access and egress to the work area and tunnels, and the remaining shaft can be used for ventilation exhaust, removal of tunnel and drill hole cuttings, produced gas and oil, removal of mine waste water and provides an escapeway for working personnel should it be required.

36. The method according to claim 35 wherein the horizontal tunnels are formed in a desired pattern extending outward from the vertical shaft to form a predetermined drain basin, the tunnels are bulwarked and shored in accordance with known mining safety techniques and regulations and are properly ventilated to assure safe working spaces for humans.

37. The method according to claim 36 wherein the horizontal tunnels each have a plurality of relative small diameter gravity-type drain wells drilled generally upward through the overlying competent rock layer roofs thereof at predetermined spaced-apart points along the lengths of the tunnels, said gravity-type drain wells extending upwardly through the overlying competent rock layer roof to extend into the overlying oil sand zone to a desired depth.

38. The method according to claim 37 wherein the horizontal tunnels are sufficiently large to accommodate utility pipelines for supply of electricity, ventilating air, compressed air steam, drilling and secondary treatment fluids and the like to gravity drain-type oil well sites along the length of the tunnel as well as return conduits for waste drilling fluids, cuttings, exhaust air, oil and/or gas, water and the like to the base of a vertical shaft for pumping back up to the surface.

39. An oil production control system for use in a petroleum mine having a network of interconnected mine shafts in which a plurality of drainage type oil well sites have been formed and which are interconnected by production conductor pipes that form a mine workings drainage oil collection piping system and wherein a number of drainage type oil well sites have been opened and the mine has been placed in production, said oil production control system comprising a main control computer located in a main control room, said main control computer having supplied thereto from suitable operating parameter sensors input electrical signals representative of such operating parameters, as fluid flow rate, fluid termperature and fluid pressure, said sensors being mounted at each drainage type oil well site and a fluid analyzer mounted at each respective drainage type oil well site for supplying type of fluid and operating parameter signal to said main control computer, said system further comprising valve means at each oil well site for individually remotely controlling with said main control computer turn-on and turn-off and the production flow rate of fluids out of the respective oil well sites and into the mine workings drainage oil collection piping system for the mine workings.

40. An oil production control system for a petroleum mine according to claim 39 wherein said valve means for controlling turn-on, turn-off and the production flow rate of fluids out of the respective oil well sites includes an individual holding tank for receiving fluids drained by each respective drainage type oil well site, a pressure actuated electric switch for sensing the pressure level built up in each respective holding tank, an electric motor actuated drain valve controlling flow of fluids out of each holding tank into the mine workings drainage oil collection piping system under the control of the pressure actuated switch and the main control computer, and sensor means for supplying data to the main control computer representative of the pressure of the drainage oil bearing fluid in the respective holding tank and the operating condition of the respective motor driven drain valve whether closed or open and if open to what extent.

41. An oil production control system for a petroleum mine according to claim 40 further including operating parameter sensors installed in said mine workings drainage oil collection piping system for sensing the operating condition of the collection system and supplying signals to said main control computer of the condition of operation thereof whereby upon the occurrence of excessive flow rates, pressures, temperatures and the like, the main control computer automatically can adjust production flow rates through the respective drainage-type oil well sites to maintain operation of the collection system within prescribed operating limits.

42. An oil production control system for a petroleum mine according to claim 41 further including booster pumps installed in said mine workings drainage oil collection system for boosting fluid flow through the system to predetermined values with each said booster pump having operating condition sensors thereon supplying electrical signals back to the main control computer indicative of the operating condition of the respective booster pump.

43. An oil production control system for a petroleum mine according to claim 42 further including separator and classifying means connected to an outlet end of the mine workings drainage oil collection piping system for separating, classifying and quantifying each type of fluid whether gas, oil or water being transported through the collection system with the output of the separator and classifying means being delivered to oil storage facilities, gas storage facilities and water utilization facilities, respectively.

44. An oil production control system for a petroleum mine according to claim 43 further including at least one supply line connected to specific drainage-type oil well through a selectively controlled on-off flow control valve capable of being remotely controlled by said main control computer for selectively controlling supply of secondary treatment agents to a selected drainage-type oil well site while turning off production flow of fluids from the well.

45. An oil production control system for a petroleum mine according to claim 44 further including at least one supply line connected to said specific drainage-type oil well through a selectively controlled on-off flow control valve capable of being remotely controlled by said main control computer for selectively controlling supply of secondary treatment agents to a selected drainage-type oil well site while turning off production flow of fluids from the well.

46. An air flow monitor and control system for a petroleum mine constructed according to claim 45 further a circulating air ducting system distributed throughout the mine workings having circulating air blower booster fans disposed therein at selected points for delivering predetermined volumes of air to the mine workings, air flow sensing means for sensing the air flow rates at selected points throughout the mine workings and supplying signals to a main control computer of the air flow rate at these points, bad air alarms located at particular points throughout the mine workings and remotely operable by the main control computer for advising personnel working in the affected areas of the onset of bad air conditions and overheated motor temperature sensors coupled to at least vital air blower motors and supplying signals back to the main control computer for monitoring the conditions of such motors.

47. A gas detection and control system for a petroleum mine constructed according to claim 46 further comprising gas sensors distributed throughout the mine workings for sensing the build-up of methane and like gases in any particular section of the mine workings and signalling an alarm of such build-up both locally and to a main control computer, motor operated airtight doors installed in the mine workings for closing and isolating predetermined sections of the mine workings, said motor operated doors being under the control of the main control computer for automatic or supervisor controlled closing in response to an alarm in any given section of the mine workings, sensor means for sensing the open or closed condition of the airtight doors and supplying signals back to the control computer indicative of the open or closed condition, manually operated controls mounted on each side of the airtight doors for allowing manual opening and egress of mine personnel out of a section of the mine closed by the main control computer, and means for automatically reshutting a door previously closed by the main control computer after it has been opened manually.

48. A fire protection system for a petroleum mine constructed according to claim 47 further comprising temperature sensors and/or smoke detectors distributed throughout the mine workings to sense the onset of a fire and to signal the existence of the fire both locally and to a main control computer and a carbon dioxide ($CO_2$) fire extinghishing system installed throughout the mine workings and under the control of the main control computer for substantially simultaneously flooding any given section of the mine workings with $CO_2$ in response to the sounding of a fire alarm signal.

49. A fire protection system for a petroleum mine according to claim 48 wherein the airtight doors sealing off any given section of the mine workings in which a fire occurs can be closed by the main control computer either automatically or under supervisor control in response to the fire alarm signal.

50. A mine flood protection system for a petroleum mine constructed according to claim 49 further comprising liquid level sensing devices installed throughout the mine workings for sensing the build-up of liquid level in any section of the workings and signalling an alarm both locally and to a main control computer of the onset of a flooding condition, sump pumps together with a sump pump discharge piping system installed throughout the mine workings, said main control computer either automatically or under supervisor control turning on the sump pumps in affected areas in response to the flooding alarm.

51. A mine flood protection system for a petroleum mine according to claim 50 wherein the airtight doors sealing off any given section of the mine workings in which flooding occurs can be closed by the main control computer either automatically or under supervisor control in response to the flooding alarm signal.

52. An oil production control system for a petroleum mine according to either claim 45 or 47 further including operating parameter sensing instruments connected to said at least one supply line for sensing such operating parameters as temperature, pressure, flow rate and the like of secondary treatment agents and supplying signals to said main control computer which are indicative of the value of such parameters.

53. An air flow monitor and control system for a petroleum mine constructed according to claim 39 further comprising a circulating air ducting system distributed throughout the mine workings having circulating air blower booster fans disposed therein at selected points for delivering predetermined volumes of air to the mine workings, air flow sensing means for sensing the air flow rates at selected points throughout the mine workings and supplying signals to a main control computer of the air flow rate at these points, bad air alarms located at particular throughout the mine workings and remotely operable by the main control computer for advising personnel working in the affected area of the onset of bad air conditions and overheated motor temperature sensors coupled to at least vital air blower motors and supplying signals back to the main control computer for monitoring the conditions of such motors.

54. A gas detection and control system for a petroleum mine constructed according to claim 53 further comprising gas sensors distributed throughout the mine workings for sensing the build-up of methane and like gases in any particular section of the mine workings and signalling an alarm of such build-up locally and to a main control computer, motor operated airtight doors installed in the mine workings for closing and isolating predetermined sections of the mine workings, said motor operated doors being under the control of the main control computer for automatic or supervisor controlled closing in response to an alarm in any given section of the mine workings, sensor means for sensing the open or closed condition of the airtight doors and supplying signals back to the control computer indicative of the open or closed condition, manually operated controls mounted on each side of the airtight doors for allowing manual opening and egress of mine personnel out of a section of the mine closed by the main control computer, and means for automatically reshutting a door previously closed by the main control computer after it has been opened manually.

55. A gas detection and control system for a petroleum mine constructed according to claim 39 further comprising gas sensors distributed throughout the mine workings for sensing the build-up of methane and like gases in any particular section of the mine workings and signalling an alarm of such build-up both locally and to a main control computer, motor operated airtight doors installed in the mine workings for closing and isolating predetermined sections of the mine workings, said motor operated doors being under the control of the main control computer for automatic or supervisor controlled closing in response to an alarm in any given section of the mine workings, sensor means for sensing the open or closed condition of the airtight doors and supplying signals back to the control computer indicative of the open or closed condition, manually operated controls mounted on each side of the airtight doors for allowing manual opening and egress of mine personnel out of a section of the mine closed by the main control computer, and means for automatically reshutting a door previously closed by the main control computer after it ahs been opened manually.

56. A first protection system for a petroleum mine constructed according to claim 55 further comprising temperature sensors and/or smoke detectors distributed throughout the mine workings to sense the onset of a fire and to signal the existence of the fire both locally and to a main control computer and a carbon dixoide ($CO_2$) fire extinguishing system installed throughout the mine workings and under the control of the main control computer for substantially simultaneously flooding any given section of the mine workings with $CO_2$ in response to the sounding of a fire alarm signal.

57. A fire protection system for a petroleum mine according to claim 56 wherein the airtight doors sealing off any given section of the mine workings in which a first occurs can be closed by the main control computer either automatically or under supervisor control in response to the fire alarm signal.

58. A fire protection system for a petroleum mine constructed according to either of claims 39, 53, or 54 comprising temperature sensors and/or smoke detectors distributed throughout the mine workings to sense the onset of a fire and to signal the existence of the fire both locally and to a main control computer and a carbon dioxide ($CO_2$) fire extinghishing system installed throughout the mine workings and under the control of the main control computer for substantially simultaneously flooding any given section of the mine workings with $CO_2$ in response to the sounding of a fire alarm signal.

59. A fire protection system for a petroleum mine according to claim 58 wherein the airtight doors sealing off any given section of the mine workings in which a fire occurs can be closed by the main control computer either automatically or under supervisor control in response to the fire alarm signal.

60. A mine flood protection system for a petroleum mine constructed according to either of claims 55, 54, 56 or 57 further comprising liquid level sensing devices installed throughout the mine workings for sensing the build-up of liquid level in any section of the workings and signalling an alarm both locally and to a main control computer of the onset of a flooding condition, sump pumps together with a sump pump discharge piping system installed throughout the mine workings, said main control computer either automatically or under supervisor control turning on the sump pumps in affected areas in response to the flooding alarm, and wherein the airtight doors sealing off any given section of the mine workings in which flooding occurs can be closed by the main control computer either automatically or under supervisor control in response to the flooding alarm signal.

61. A mine flood protection system for a petroleum mine constructed according to claim 39 further comprising liquid level sensing devices installed throughout the mine workings for sensing the build-up of liquid level in any section of the workings and signalling an alarm both locally and to a main control computer of the onset of a flooding condition, sump pumps together with a sump pump discharge piping system installed throughout the mine workings, said main control computer either automatically or under supervisor control turning on the sump pumps in affected areas in response to the flooding alarm.

62. A mine flood protection system for a petroleum mine according to claim 61 having airtight doors sealing off any given section of the mine workings in which flooding occurs and which can be closed by the main control computer either automatically or under supervisor control in response to the flooding alarm signal.

63. A motor monitoring and protection system for a petroleum mine constructed according to either of claims 39, 43, 45, 46, 47, 56, 49, 61 or 51 further comprising electric motor monitoring instrument means mounted on each vital motor installed in the mine workings for operating valves, blowers, pumps, doors and the like, and for providing signals indicative of the operating conditions of the motors to the main control computer for read-out and display in supervising operation of the mine.

* * * * *